US009399904B2

(12) United States Patent
Milam et al.

(10) Patent No.: US 9,399,904 B2
(45) Date of Patent: Jul. 26, 2016

(54) OIL RECOVERY SYSTEM AND METHOD

(71) Applicant: SHELL OIL COMPANY, Houston, TX (US)

(72) Inventors: Stanley Nemec Milam, Houston, TX (US); Erik Willem Tegelaar, Rijswijk (NL); John Justin Freeman, Pattison, TX (US)

(73) Assignee: Shell Oil Company, Houston, TX (US)

( * ) Notice: Subject to any disclaimer, the term of this patent is extended or adjusted under 35 U.S.C. 154(b) by 0 days.

(21) Appl. No.: 14/305,965

(22) Filed: Jun. 16, 2014

(65) Prior Publication Data

US 2014/0367097 A1 Dec. 18, 2014

Related U.S. Application Data

(60) Provisional application No. 61/836,521, filed on Jun. 18, 2013.

(51) Int. Cl.

| | |
|---|---|
| ***E21B 43/24*** | (2006.01) |
| ***E21B 43/22*** | (2006.01) |
| ***E21B 43/25*** | (2006.01) |

(52) U.S. Cl.

CPC ..... *E21B 43/24* (2013.01); *E21B 43/2408* (2013.01); *E21B 43/25* (2013.01)

(58) Field of Classification Search

CPC ..... E21B 43/24; E21B 43/2408; E21B 43/25; E21B 43/2406; E21B 43/40

See application file for complete search history.

(56) References Cited

U.S. PATENT DOCUMENTS

| | | | |
|---|---|---|---|
| 1,514,113 | A | 11/1924 | Trumble |
| 3,249,157 | A | 5/1966 | Brigham et al. |
| 3,467,187 | A | 9/1969 | Gagarty et al. |
| 3,570,601 | A | 3/1971 | Dauben et al. |
| 3,822,748 | A | 7/1974 | Allen et al. |
| 3,838,738 | A | 10/1974 | Redford et al. |
| 4,022,277 | A | 5/1977 | Routson |
| 4,250,963 | A | 2/1981 | Hess |
| 4,280,559 | A | 7/1981 | Best |
| 4,302,605 | A | 11/1981 | Buchholz et al. |
| 4,347,118 | A | 8/1982 | Funk et al. |
| 4,348,486 | A | 9/1982 | Calvin et al. |
| 4,379,490 | A | 4/1983 | Sharp |

(Continued)

FOREIGN PATENT DOCUMENTS

| | | |
|---|---|---|
| CA | 1209077 A1 | 8/1986 |
| CN | 102132003 | 7/2011 |

(Continued)

OTHER PUBLICATIONS

"Molecular modeling the microstructure and phase behavior of bulk and inhomogeneous complex fluids", Adam Bymaster, Rice University, UMI No. 3362135. 2009.

(Continued)

*Primary Examiner* — Zakiya W Bates

(74) *Attorney, Agent, or Firm* — Richard B. Taylor

(57) ABSTRACT

A system and process for recovering oil from an oil-bearing formation. An oil recovery formulation that is first contact miscible with a liquid petroleum composition that is comprised of at least 15 mol % dimethyl sulfide is introduced together with steam or hot water into a subterranean oil-bearing formation comprising heavy oil, extra heavy oil, or bitumen, and oil is produced from the formation.

29 Claims, 11 Drawing Sheets

(56) References Cited

U.S. PATENT DOCUMENTS

| | | | | |
|---|---|---|---|---|
| 4,414,120 | A | 11/1983 | Malloy et al. | |
| 4,415,032 | A | 11/1983 | Shu | |
| 4,486,340 | A | 12/1984 | Glass, Jr. | |
| 4,544,033 | A | 10/1985 | Ukigai et al. | |
| 4,572,777 | A | 2/1986 | Peck | |
| 4,580,633 | A | 4/1986 | Watkins et al. | |
| 4,584,087 | A | 4/1986 | Peck | |
| 4,699,709 | A | 10/1987 | Peck | |
| 4,722,782 | A | 2/1988 | Graham et al. | |
| 4,867,256 | A | 9/1989 | Snead | |
| 5,043,056 | A | 8/1991 | Pratt et al. | |
| 5,044,435 | A | 9/1991 | Sperl et al. | |
| 5,143,598 | A | 9/1992 | Graham et al. | |
| 5,232,049 | A | 8/1993 | Christiansen et al. | |
| 5,411,231 | A | 5/1995 | Buck | |
| 5,425,422 | A | 6/1995 | Jamaluddin et al. | |
| 6,662,872 | B2 | 12/2003 | Gutek et al. | |
| 6,708,759 | B2 | 3/2004 | Leaute et al. | |
| 7,601,320 | B2 | 10/2009 | Van Dorp et al. | |
| 8,176,982 | B2 | 5/2012 | Gil et al. | |
| 2003/0130360 | A1 | 7/2003 | Kindig et al. | |
| 2003/0196816 | A1 | 10/2003 | Aronstam | |
| 2006/0219409 | A1 | 10/2006 | Dyer | |
| 2008/0020949 | A1 | 1/2008 | Trimble | |
| 2008/0263953 | A1 * | 10/2008 | Okada | B01J 8/0492 48/127.9 |
| 2009/0020289 | A1 | 1/2009 | Sharif | |
| 2009/0025935 | A1 | 1/2009 | Van Dorp et al. | |
| 2009/0056941 | A1 | 3/2009 | Valdez | |
| 2009/0236899 | A1 | 9/2009 | Geisler | |
| 2010/0009115 | A1 | 1/2010 | Ruhdorfer | |
| 2010/0047793 | A1 | 2/2010 | Toledo et al. | |
| 2010/0065275 | A1 | 3/2010 | McGowen et al. | |
| 2010/0130386 | A1 | 5/2010 | Chakrabarty | |
| 2011/0009556 | A1 | 1/2011 | Faust, Jr. et al. | |
| 2011/0108269 | A1 | 5/2011 | Van Den Berg et al. | |
| 2011/0132617 | A1 | 6/2011 | Wang | |
| 2011/0146979 | A1 | 6/2011 | Wallace | |
| 2011/0272325 | A1 | 11/2011 | Soane et al. | |
| 2011/0295771 | A1 | 12/2011 | Dawson | |
| 2012/0037363 | A1 | 2/2012 | Curole | |
| 2012/0152570 | A1 | 6/2012 | Thomas | |
| 2012/0227975 | A1 * | 9/2012 | Ayirala | E21B 43/40 166/344 |
| 2012/0241150 | A1 | 9/2012 | Al Yahyai et al. | |

FOREIGN PATENT DOCUMENTS

| | | | |
|---|---|---|---|
| EP | 2225343 | | 5/2009 |
| WO | 2009058889 | | 5/2009 |
| WO | 2011019632 | | 2/2011 |
| WO | 2011021092 | A2 | 2/2011 |
| WO | 2012158645 | | 11/2012 |

OTHER PUBLICATIONS

"Flow Dynamics for Dense Packing of Drops in a Spray Column. Effect of the Viscosity of the Two Fluids", R. Luataty and M. Perrut, Chem. Eng. Sci. V. 27 No. 4, pp. 669-676 (Apr. 1972).

"The Removal and Recovery of Organic Sulfur Compounds from Petroleum Hydrocarbons by Liquid-Liquid Extraction. The Effect of Halogenide Ligands on the Rate of Sulfide Extraction with Transition Metal Complexes", T. Kamidate, K. Aomura, T. Yotsuyanagi; Kogyo Kagaku Zasshi, vol. 74, No. 7 A63, pp. 1407-1410 (Jul. 1971).

"Characterization of Trace Gases Measured Over Alberta Oil Sands Mining Operations: 76 Speciated C2-C10 Volatile Organic Compounds (VOCs), CO2, CH4, CO, NO, NO2, O3, and SO2", Atmospheric Chemistry and Physics, I.J. Simpson et al, 10, 11931-11954, 2010.

Graham, R.J., et al.: A Solvent Extraction Process for Tar Sand, 1987 Eastern OH Shale Symposium, Commonwealth of Kentucky, Kentucky Energy Cabinet, pp. 93-99 (1987).

Yotsuyanagi, Takao et al., "Studies on the Removal & Recovery of Organic Sulfur Compounds in Hydrocarbon Oils by Liquid-Liquid Extractionan(IV)"—The Solvent Extraction of Tetrahydrothiophene with Aqueous Bromo-Copper(II) Complex Solutions—, Bulletin of the Japan Petroleum Institute, vol. 17, No. 1, Apr. 1975, pp. 108-113.

Kamidate, T., et al.:"The Removal and Recovery of Organic Sulfur Compounds from Petroleum Hydrocarbons by Liquid-Liquid Extraction. The Effect of Halogenide Ligands on the Rate of Sulfide Extraction with Transition Metal Complexes", vol. 74, No. 7 A63, pp. 1407-1410 (Jul. 1971).

Luataty, R.: Flow Dynamics for Dense Packing of Drops in a Spray Column. Effect of the Viscosity of the Two Fluids, Chem. Eng. Sci. V. 27 No. 4, pp. 669-676 (Apr. 1972).

Gaylord Material Safety Data Sheet, Dimethyl Sulfide (DMS), MSDS # GCC2-8, Sep. 2010.

Gaylord Chemical Co. LLC, "Dimethyl Sulfide Overview", Bulletin #200B, Oct. 2007, pp. 1-11.

Girish et al., "Flexicoking,Coking and Integrated Steam/Air Gasification", 8th Annual Canadian Oil Sands Summit, Calgary, Alberta, Canada, Feb. 2-3, 2011.

Gray et al., Upgrading Petroleum Residues and Heavy Oils, University of Alberta, Canada, 1994, Chemical Industries, vol. 56, pp. 237-252.

Iliuta, M. C. et al., Solubility of Total Reduced Sulfurs (Hydrogen Sulphide, Methyl Mercaptan, Dimethyl Sulphide & Dimethyl Disulfide) in Liquids, Journal of Chemical & Engineering Data, American Chemcal Society, US, vol. 52, No. 1, 2007, pp. 2-19.

Perrut M. et al., "Hydrodynamic Flow in Dense Bed in a Column Has Spray influence of the Viscosity of Liquids Burdens", Chemical Engineering Science, 1972, vol. 27, pp. 669-676.

PCT International Search Report mailed Oct. 20, 2014 for, Application No. PCT/US2014/044026 filed Jun. 25, 2014.

* cited by examiner

OIL RECOVERY SYSTEM AND METHOD

RELATED CASES

This application claims benefit of U.S. Provisional Application No. 61/836,521, filed on Jun. 18, 2013, which is incorporated herein by reference.

FIELD OF THE INVENTION

The present invention is directed to a system and a method of recovering oil from a subterranean formation, in particular, the present invention is directed to a method of enhanced oil recovery from a subterranean formation.

BACKGROUND OF THE INVENTION

A large quantity of oil worldwide is located in heavy oil and bitumen containing formations. Not including hydrocarbons in oil shale, it has been estimated that there are 1.3 to 1.5 trillion cubic meters (8-9 trillion barrels) of heavy oil and bitumen in-place worldwide. Heavy oil and bitumen containing formations may occur from the surface of the earth to a depth of more than 2000 meters. Heavy oil or bitumen in such formations at a depth of 75 meters or greater may be recovered by in situ extraction wherein wells are drilled into the formation to extract the oil.

In situ extraction of oil from heavy oil or bitumen containing formations is typically impeded by the viscosity of the heavy oil or bitumen. Generally, the viscosity of oil in a heavy oil or bitumen containing formation is sufficiently great that the oil does not easily flow to a well for production.

Thermal methods have been provided for in situ extraction of oil from a heavy oil or bitumen containing formation wherein the viscosity of the oil in the formation is reduced by heating the oil in the formation, thereby mobilizing the oil in the formation for production from the formation via a well. Steam has been used to provide heat in some thermal methods for reducing the viscosity of oil in heavy oil or bitumen containing formations. Steam assisted gravity drainage (SAGD), cyclic steam stimulation (CSS), and vertical steam drive (VSD) are common thermal methods utilized for reducing the viscosity of heavy oil or bitumen in a formation by heating the formation with steam that is injected into the formation.

Solvents have been used in combination with steam to enhance mobilization of oil in a heavy oil or bitumen containing formation for production from the formation. Low molecular weight hydrocarbons have been utilized in combination with steam to reduce the viscosity of bitumen in situ and enhance recovery of hydrocarbons from a bitumen-containing formation. For example, U.S. Pat. No. 6,662,872 provides a process for reducing the viscosity of bitumen in a formation and enhancing recovery thereof by co-injecting steam and a $C_1$-$C_8$ normal hydrocarbon (e.g. methane, ethane, propane, butane, pentane, hexane, heptane, or octane), and U.S. Pat. No. 6,708,759 provides a process for reducing the viscosity of bitumen in a formation and enhancing recovery thereof that, in part, requires co-injecting steam and liquid petroleum condensate comprised of low molecular weight paraffinic hydrocarbons. Higher molecular weight hydrocarbons including aromatic hydrocarbons have also been used in combination with steam to recover heavy viscous oils such as bitumen from an oil-bearing formation. For example, U.S. Pat. No. 4,280,559 discloses a process in which steam is injected into a viscous oil-bearing formation, hydrocarbons are recovered, then a hydrocarbon solvent containing a low concentration of low molecular weight paraffinic hydrocarbons, preferably being light naphtha, gasoline, and or aromatic solvents including benzene, toluene, or xylene is injected into the formation followed by a second steam injection, and hydrocarbons are then recovered from the formation. U.S. Pat. No. 3,838,738 further discloses the use of aromatic hydrocarbons such as benzene and toluene in combination with steam to recover bitumen from a bitumen-containing formation by injecting steam and the aromatic hydrocarbons in a flow path in the formation between an injection well and a production well, where the aromatic hydrocarbons vaporize in the flow path, and the vaporized hydrocarbons condense and mix with the bitumen thereby mobilizing the bitumen for production from the formation through the production well. Other solvents such as carbon disulfide or halogenated hydrocarbons have also been used in combination with steam to mobilize viscous, heavy oils such as bitumen in situ for production from a heavy-oil bearing formation. U.S. Pat. No. 3,838,738 further discloses that carbon disulfide may be used together with steam to mobilize bitumen for production from a bitumen-containing formation, and U.S. Pat. No. 3,822,748 discloses that carbon disulfide or halogenated hydrocarbons may be used as petroleum miscible fluids together with steam at a steam temperature of less than 121° C. (250° F.) to mobilize bitumen for production from a tar sand formation.

The solvents that have been utilized in combination with steam to mobilize viscous oil for production, however, each have attendant difficulties when used to recover oil from a heavy oil or bitumen containing formation. A portion of heavy oil or bitumen, in particular the asphaltene fraction of the heavy oil or bitumen, is not soluble in low molecular weight hydrocarbons, particularly paraffins and most particularly normal paraffins. or paraffinic low molecular weight hydrocarbons. As a result, utilization of a low molecular weight hydrocarbon solvent in combination with steam to extract oil from a heavy oil or bitumen containing formation 1) leaves a substantial fraction of the oil that is not soluble in the solvent in place in the formation, reducing yield; and 2) potentially blocks mobilization of producible oil in the formation by precipitating asphaltenes within the formation. Heavier hydrocarbons such as aromatic hydrocarbons, light naphtha, and gasoline are more miscible with heavy oil and bitumen and do not precipitate asphaltenes from heavy oil or bitumen when used as a solvent in conjunction with steam to extract oil from a heavy oil or bitumen containing formation, however, due to their higher vaporization temperatures, a substantial amount of energy is required to separate these solvents from the produced oil. Economically, use of either the light molecular weight hydrocarbons or the heavier hydrocarbons as a solvent for use in combination with steam for in situ mobilization and recovery of oil from a heavy oil or bitumen containing formation is not practical since the cost and availability of the solvent, particularly heavier hydrocarbons, is prohibitive.

Carbon disulfide, while miscible with heavy oil or bitumen, is not particularly useful in combination with steam for use in situ for recovery of oil from a heavy oil or bitumen containing formation since 1) carbon disulfide is easily hydrolyzed in the presence of steam to form hydrogen sulfide and carbon dioxide, thereby souring and acidifying the formation and 2) is more dense than oil and water, and falls to the bottom of the formation. Halogenated hydrocarbons, also miscible with heavy oil and bitumen, are not particularly useful in combination with steam for in situ recovery of oil from a heavy oil or bitumen containing formation since halogenated hydrocarbons poison oil hydroprocessing catalysts and, therefore, must be completely removed from recovered oil prior to processing the recovered oil and because halogenated hydrocarbons are mutagenic.

It is desirable, therefore, to provide an improved process and a system for recovering oil from a heavy oil or bitumen containing formation.

SUMMARY OF THE INVENTION

In one aspect, the present invention is directed to a method for producing oil comprising:

providing an oil recovery formulation that comprises at least 15 mol % dimethyl sulfide, wherein the oil recovery formulation is first contact miscible with liquid phase petroleum;

providing steam or hot water having a temperature of at least 80° C.;

introducing the steam or hot water and the oil recovery formulation together into a subterranean oil-bearing formation comprising crude oil having a dynamic viscosity of at least 1000 mPa s (1000 cP) at 25° C. and an API gravity at 15.5° C. (60° F.) of at most 20° as measured in accordance with ASTM D6822, wherein the oil recovery formulation comprises at least 15 wt. % of the combined steam and oil recovery formulation introduced together into the formation;

contacting the steam or hot water and the oil recovery formulation with the oil in the formation; and producing oil from the formation after introducing the steam or hot water and the oil recovery formulation into the formation.

In another aspect, the present invention is directed to a system, comprising:

an oil recovery formulation comprised of at least 15 mol % dimethyl sulfide, wherein the oil recovery formulation is first contact miscible with liquid phase petroleum;

steam or hot water having a temperature of at least 80° C.;

a mechanism for introducing the oil recovery formulation and the steam or hot water together into a subterranean oil-bearing formation comprising oil having a viscosity of at least 1000 mPa s (1000 cP) at 25° C. and an API gravity at 15.5° C. (60° F.) of at most 20°; and a mechanism for producing oil from the subterranean oil-bearing formation subsequent to the introduction of the oil recovery formulation and the steam or hot water into the formation.

BRIEF DESCRIPTION OF THE DRAWINGS

The drawing figures depict one or more implementations in accordance with the present teachings, by way of example only, not by way of limitation. In the figures, like reference numerals refer to the same or similar elements.

DETAILED DESCRIPTION OF THE INVENTION

Figure 1:
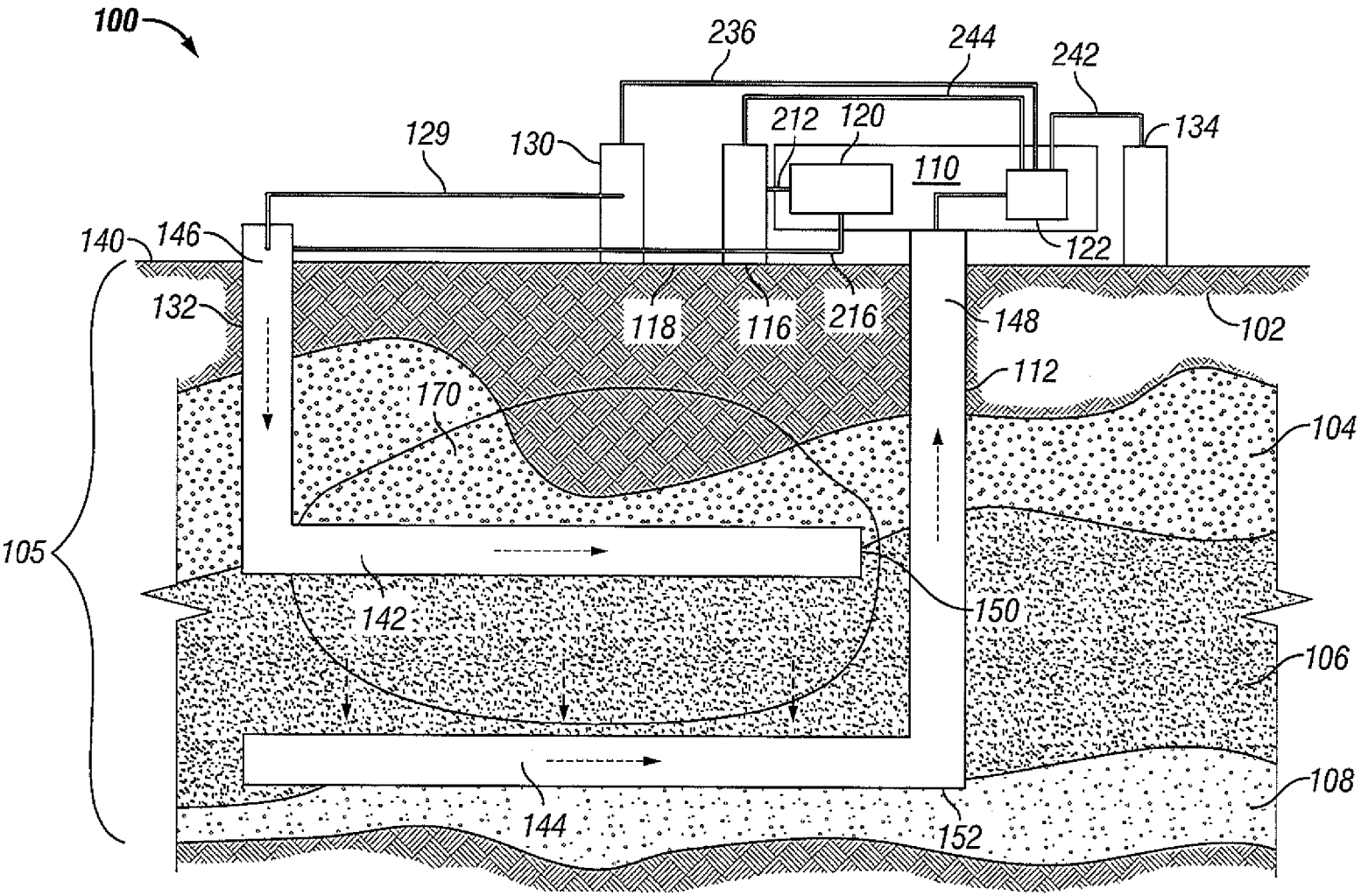
FIG. 1 illustrates an oil production system that may be used to practice the process of the present invention.

The present invention is directed to a method and a system for enhanced oil recovery from a subterranean oil-bearing formation comprised of heavy oil, extra-heavy oil, or bitumen utilizing steam or hot water and an oil recovery formulation comprising at least 15 mol % dimethyl sulfide, wherein the oil recovery formulation is introduced into the formation together with the steam or hot water. The oil recovery formulation is first contact miscible with liquid phase petroleum, and, in particular, is first contact miscible with oil in the subterranean oil-bearing formation.

The steam or hot water introduced into the formation provides heat to the formation, rendering the oil therein less viscous. The oil recovery formulation may have a very low viscosity so that upon introduction of the oil recovery formulation into the formation with steam or hot water the miscible oil recovery formulation may completely mix with the oil it contacts to produce a mixture having a significantly reduced viscosity relative to the oil initially in place in the formation. The oil recovery formulation may be vaporized within the formation by the heat provided by the steam or hot water that is introduced into the formation with the oil recovery formulation so the oil recovery formulation may penetrate the formation to contact the oil therein and mobilize the oil upon condensation and mixing with the oil by reducing the viscosity of the oil. The reduced viscosity mixture may be mobilized for movement through the subterranean formation, where the mobilized mixture may be produced from the formation, thereby recovering oil from the formation.

The dimethyl sulfide (also referred to herein as "DMS") of the oil recovery formulation is particularly useful as a solvent for mobilizing viscous oil in a formation when introduced into the formation together with steam or hot water. DMS has a relatively low vaporization temperature and may be vaporized upon introduction of the DMS and steam or hot water into the formation. DMS is miscible with all portions of the oil including low molecular weight paraffins, residue, and asphaltenes and does not precipitate a portion of the oil upon contacting the oil, so that all portions of the oil may be recovered from the formation. DMS does not impair permeability of the formation by precipitation of a fraction of the oil. DMS may be produced with the produced oil and may be easily recovered from the produced oil due to the low vaporization temperature of DMS. Furthermore, unlike carbon disulfide, DMS is not susceptible to hydrolysis at temperatures at which the combination of steam or hot water and DMS may be provided to the formation or at temperatures within the formation. DMS is also relatively non-toxic.

Certain terms used herein are defined as follows:

"API gravity" as used herein refers to API gravity at 15.5° C. (60° F.) as determined by ASTM Method D6822.

"Asphaltenes", as used herein, are defined as hydrocarbons that are insoluble in n-heptane and soluble in toluene at standard temperature and pressure.

"Operatively fluidly coupled or operatively fluidly connected", as used herein, defines a connection between two or more elements in which the elements are directly or indirectly connected to allow direct or indirect fluid flow between the elements. The term "fluid flow", as used in this definition, refers to the flow of a gas or a liquid; the term "direct fluid flow" as used in this definition means that the flow of a liquid or a gas between two defined elements flows directly between the two defined elements; and the term "indirect fluid flow" as used in this definition means that the flow of a liquid or a gas between two defined elements may be directed through one or more additional elements to change one or more aspects of the liquid or gas as the liquid or gas flows between the two defined elements. Aspects of a liquid or a gas that may be changed in indirect fluid flow include physical characteristics, such as the temperature or the pressure of a gas or a liquid; the state of the fluid between a liquid and a gas; and/or the composition of the gas or liquid.

"Indirect fluid flow", as defined herein, excludes changing the composition of the gas or liquid between the two defined elements by chemical reaction, for example, oxidation or reduction of one or more elements of the liquid or gas.

"Miscible", as used herein, is defined as the capacity of two or more substances, compositions, or liquids to be mixed in any ratio without separation into two or more phases.

"Petroleum", as used herein, is defined as a naturally occurring mixture of hydrocarbons, generally in a liquid state, which may also include compounds of sulfur, nitrogen, oxygen, and metals.

"Residue", as used herein, refers to petroleum components that have a boiling range distribution above 538° C. (1000° F.) as determined by ASTM Method D7169.

The oil recovery formulation provided for use in the method or system of the present invention is comprised of at least 15 mol % dimethyl sulfide. The oil recovery formulation may be comprised of at least 20 mol %, or at least 30 mol %, or at least 50 mol %, or at least 75 mol %, or at least 90 mol %, or at least 99 mol % dimethyl sulfide. The oil recovery formulation may consist essentially of dimethyl sulfide, or may consist of dimethyl sulfide.

The oil recovery formulation provided for use in the method or system of the present invention may be comprised of one or more co-solvents that form a mixture with the dimethyl sulfide in the oil recovery formulation. The one or more co-solvents may be compounds that form an azeotropic mixture with dimethyl sulfide. The one or more co-solvents may be compounds that are recovered from the formation upon production of oil and the oil recovery formulation from the formation and are separated from the oil upon separation of DMS from the oil, for example, compounds that have a vaporization temperature near or at the vaporization temperature of DMS, and particularly compounds that form an azeotropic mixture with DMS that are recovered from the formation and are separated together with DMS from oil produced from the formation. Co-solvent compounds that may form an azeotropic mixture with DMS that may be included in the oil recovery formulation are pentane, isopentane, 2-methyl-2-butene, and isoprene. The oil recovery formulation may be comprised of at least 15 mol % DMS and one or more compounds selected from the group consisting of pentane, isopentane, 2-methyl-2-butene, and isoprene.

Less preferably, the oil recovery formulation may also include one or more other co-solvent compounds that do not form azeotropic mixtures with DMS. The one or more other co-solvents may be selected from the group consisting of o-xylene, toluene, carbon disulfide, dichloromethane, trichloromethane, $C_3$-$C_8$ aliphatic and aromatic hydrocarbons, natural gas condensates, hydrogen sulfide, diesel, naphtha solvent, asphalt solvent, kerosene, and dimethyl ether.

The oil recovery formulation provided for use in the method or system of the present invention is first contact miscible with liquid petroleum compositions, preferably any liquid petroleum composition. In liquid phase or in gas phase the oil recovery formulation may be first contact miscible with substantially all crude oils including heavy crude oils, extra-heavy crude oils, and bitumen, and is first contact miscible in liquid phase or in gas phase with the oil in the oil-bearing formation. The oil recovery formulation may be first contact miscible with a hydrocarbon composition, for example a liquid phase petroleum, that comprises at least 25 wt. %, or at least 30 wt. %, or at least 35 wt. %, or at least 40 wt. % residue. The oil recovery formulation may be first contact miscible with liquid phase residue and liquid phase asphaltenes in a hydrocarbonaceous composition. The oil recovery formulation may also be first contact miscible with $C_3$ to $C_8$ aliphatic and aromatic hydrocarbons containing less than 5 wt. % oxygen, less than 10 wt. % sulfur, and less than 5 wt. % nitrogen.

The oil recovery formulation may be first contact miscible with oil having a moderately high or a high viscosity. The oil recovery formulation may be first contact miscible with oil having a dynamic viscosity of at least 1000 mPa s (1000 cP), or at least 5000 mPa s (5000 cP), or at least 10000 mPa s (10000 cP), or at least 50000 mPa s (50000 cP), or at least 100000 mPa s (100000 cP), or at least 500000 mPa s (500000 cP) at 25° C. The oil recovery formulation may be first contact miscible with oil having a dynamic viscosity of from 1000 mPa s (1000 cP) to 5000000 mPa s (5000000 cP), or from 5000 mPa s (5000 cP) to 1000000 mPa s (1000000 cP), or from 10000 mPa s (10000 cP) to 500000 mPa s (500000 cP), or from 50000 mPa s (50000 cP) to 100000 mPa s (100000 cP) at 25° C.

The oil recovery formulation provided for use in the method or system of the present invention preferably has a low viscosity. The oil recovery formulation may be a fluid having a dynamic viscosity of at most 0.35 mPa s (0.35 cP), or at most 0.3 mPa s (0.3 cP), or at most 0.285 mPa s (0.285 cP) at a temperature of 25° C.

The oil recovery formulation provided for use in the method or system of the present invention preferably has a relatively low density. The oil recovery formulation may have a density of at most 0.9 g/cm$^3$, or at most 0.85 g/cm$^3$ at 20° C.

The oil recovery formulation provided for use in the method or system of the present invention may have a relatively high cohesive energy density. The oil recovery formulation provided for use in the method or system of the present invention may have a cohesive energy density of at least 1255 Pa, or at least 1340 Pa.

The oil recovery formulation provided for use in the method or system of the present invention preferably is relatively non-toxic or is non-toxic. The oil recovery formulation may have an aquatic toxicity of $LC_{50}$ (rainbow trout) greater than 200 mg/l at 96 hours. The oil recovery formulation may have an acute oral toxicity of $LD_{50}$ (mouse and rat) of from 535 mg/kg to 3700 mg/kg, an acute dermal toxicity of $LD_{50}$ (rabbit) of greater 5000 mg/kg, and an acute inhalation toxicity of $LC_{50}$ (rat) of 40250 ppm at 4 hours.

In the method of the present invention the oil recovery formulation is introduced together with steam or hot water having a temperature of at least 80° C. into a subterranean oil-bearing formation, and the system of the present invention includes a subterranean oil-bearing formation. The subterranean oil-bearing formation comprises crude oil and may comprise unconsolidated sand, rock, minerals, and water. The subterreanean oil-bearing formation is located beneath an overburden that may extend from the earth's surface to the oil-bearing formation. The subterranean oil-bearing formation may be located at a depth of at least 75 meters, or at least 100 meters, or at least 500 meters, or at least 1000 meters, or at least 1500 meters below the earth's surface. The subterranean oil-bearing formation may have a permeability of from 0.00001 to 15 Darcy, or from 0.001 to 5 Darcy, or from 0.01 to 1 Darcy. The subterranean formation may be a subsea formation.

The subterranean oil-bearing formation comprises oil that may be separated and produced from the formation after contact and mixing with the oil recovery formulation. The crude oil of the oil-bearing formation is first contact miscible with the oil recovery formulation under formation pressure and temperature conditions as produced when the oil recovery formulation is introduced into the formation with steam or hot water, and is also first contact miscible with the oil recovery formulation and at standard temperature and pressure conditions. The crude oil of the oil-bearing formation is heavy oil, extra heavy oil, or bitumen. Heavy oil has an API Gravity of at most 20°. Extra heavy oil and bitumen each have an API gravity of at most 10°.

Prior to the introduction of the oil recovery formulation and the steam or hot water to the subterranean oil-bearing formation, the crude oil contained in the formation has a dynamic viscosity under formation temperature conditions (specifically, at temperatures within the temperature range of the formation) of at least 1000 mPa s (1000 cP). The crude oil contained in the oil-bearing formation may have a dynamic viscosity under formation temperature conditions of at least 5000 mPa s (5000 cP), or at least 10000 mPa s (10000 cP), or at least 20000 mPa s (20000 cP) or at least 50000 mPa s (50000 cP), or at least 100000 mPa s. The crude oil contained in the oil-bearing formation may have a viscosity of from 1000 to 10000000 mPa s (1000-10000000 cP), or from 5000 to 1000000 mPa s (5000-1000000 cP), or from 10000 to 500000 mPa s (10000-500000 cP) under formation temperature conditions. The crude oil contained in the oil-bearing formation has a dynamic viscosity of at least 1000 mPa s (1000 cP) at 25° C., and may have a dynamic viscosity at 25° C. of at least 5000 mPa s (5000 cP), or at least 10000 mPa s (10000 cP), or at least 20000 mPa s (20000 cP), or at least 50000 mPa s (50000 cP), or at least 100000 mPa s (100000 cP). In an embodiment of the method and the system of the present invention, the viscosity of the crude oil contained in the oil-bearing formation is at least partially, or is substantially, responsible for immobilizing at least a portion of the petroleum in the formation.

The crude oil contained in the oil-bearing formation may contain a substantial quantity of high molecular weight hydrocarbons. The crude oil contained in the oil-bearing formation may contain at least 25 wt. %, or at least 30 wt. %, or at least 35 wt. %, or at least 40 wt. % of hydrocarbons having a boiling point of at least 538° C. (1000° F.) as determined in accordance with ASTM Method D7169. The crude oil contained in the oil-bearing formation may have an asphaltene content of at least 1 wt. %, or at least 5 wt. %, or at least 10 wt. %.

The subterranean oil-bearing formation may further comprise sand and water. The sand may be unconsolidated sand mixed with the oil and water in the formation. The crude oil may comprise from 1 wt. % to 20 wt. % of the oil/sand/water mixture; the sand may comprise from 80 wt. % to 85 wt. % of the oil/sand/water mixture; and water may comprise from 1 wt. % to 20 wt. % of the oil/sand/water mixture. The sand may be coated with a layer of water with the oil located in the void space around the wetted sand grains. The subterranean oil-bearing formation may also include a small volume of gas such as methane or air.

Figure 2:
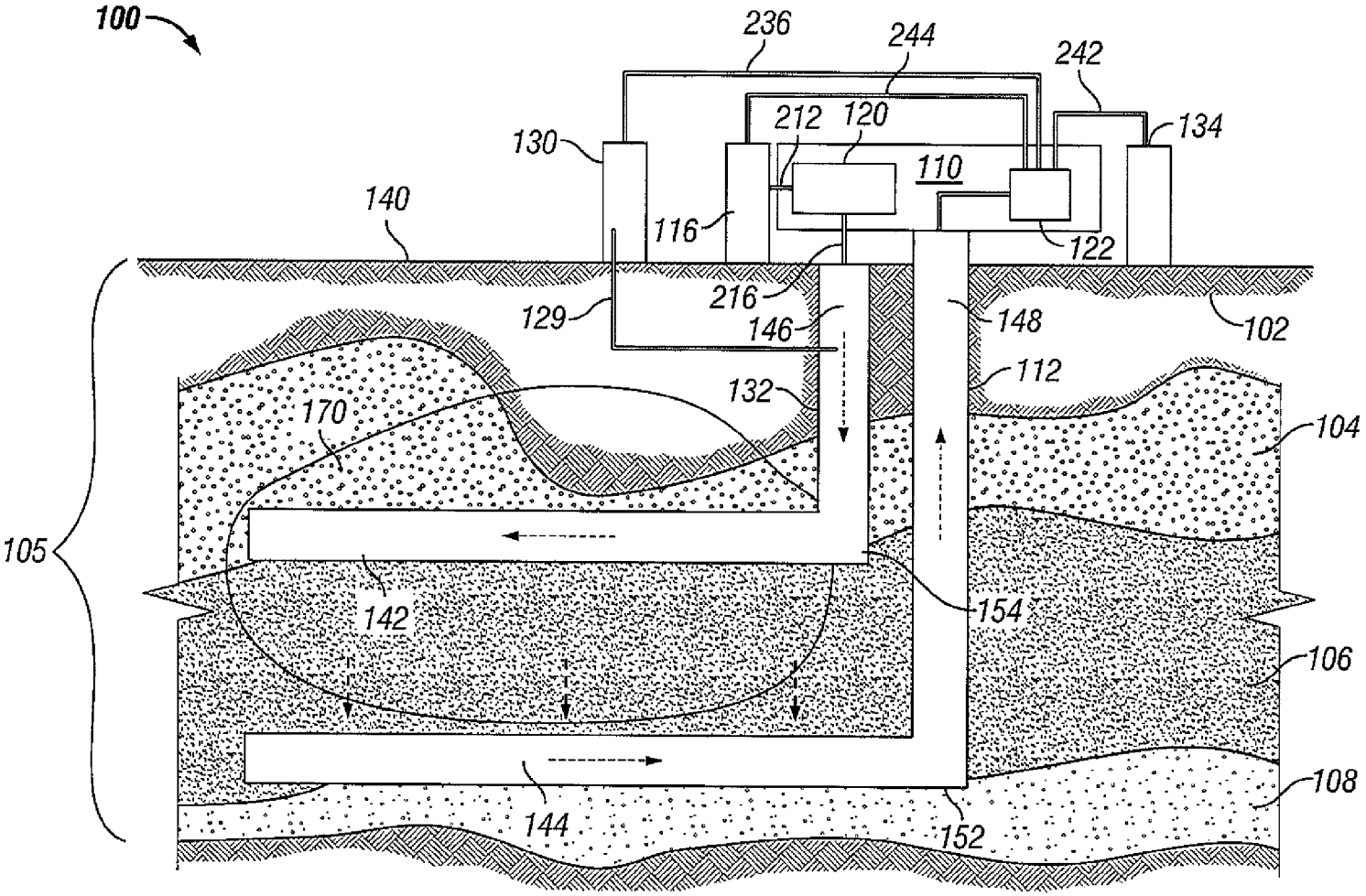
FIG. 2 illustrates an oil production system that may be used to practice the process of the present invention.

Referring now to FIGS. 1 and 2, oil production systems 100 are illustrated that may be used to practice one or more embodiments of a steam assisted gravity drainage (SAGD) process in accordance with a process of the present invention. An oil production system 100 includes an oil-bearing formation 105 that may be comprised of oil-bearing portions 104, 106, and 108 located beneath an overburden 102. The oil production system 100 may include a first well 132 through which the oil recovery formulation, or components thereof, and steam may be injected together into the formation 105, and a second well 112 through which oil, water, and at least a portion of the oil recovery formulation may be produced. The oil production system may also include a water storage facility 116, an oil recovery formulation storage facility 130, and an oil storage facility 134.

Figure 3:
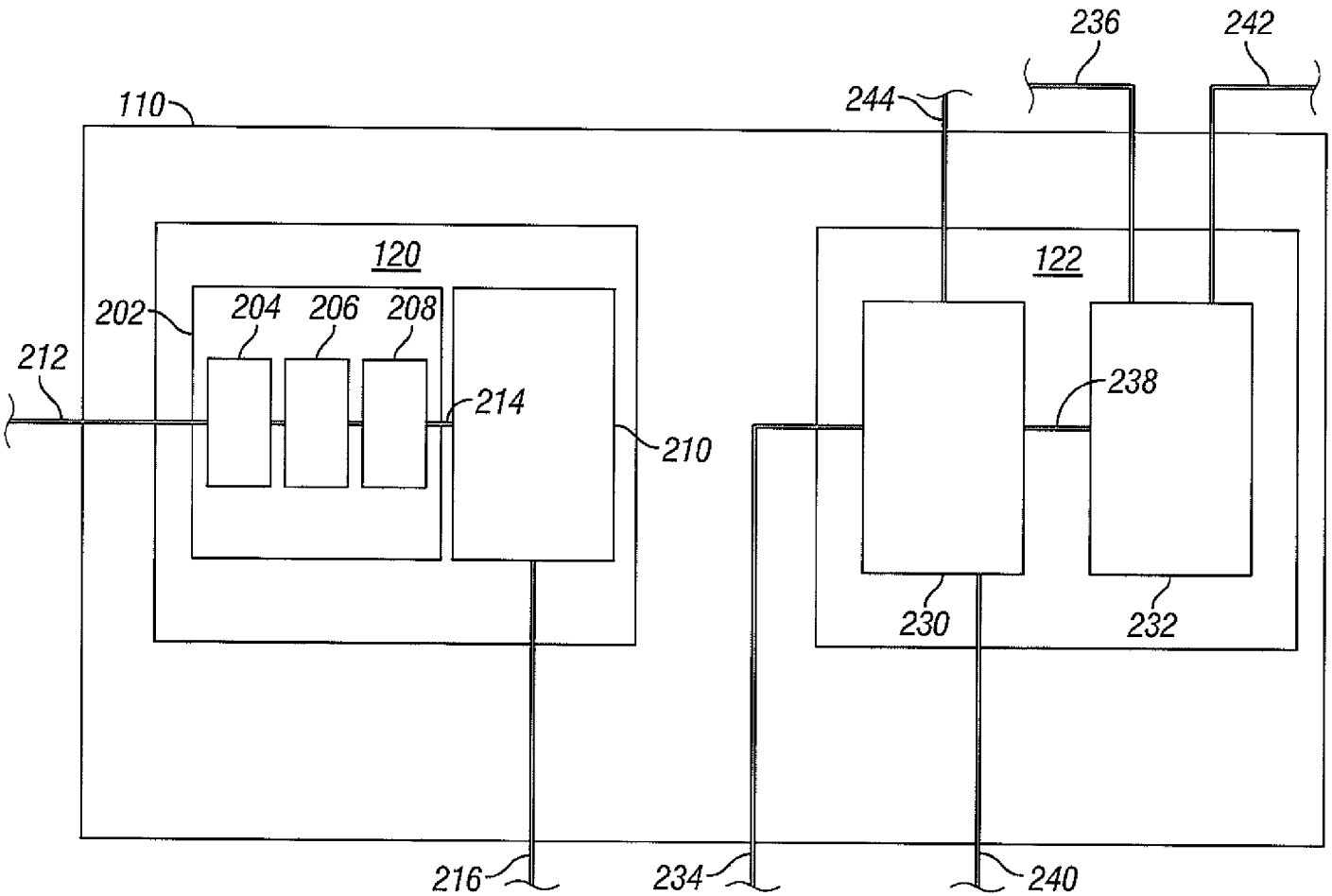
FIG. 3 illustrates a processing facility that may be used in the practice of the process of the present invention.

The oil production system 100 may also include a processing facility 110. The processing facility 110 may include a water processing system 120 and a separation unit 122. Referring now to FIG. 3, the water processing system 120 may be comprised of a water purification unit 202 comprising one or more particulate filters 204, which may include an ultrafiltration membrane; one or more ionic filtration units 206 such as a nanofiltration membrane unit and/or a reverse osmosis unit; and/or one or more ion exchange systems 208 for removing ions from water. Source water may enter the water purification unit 202 through line 212 and proceed through the particulate filters 204 for removal of suspended solids from the source water, and then proceed through the ionic filtration unit 206 and/or the ion exchange system 208 for removal of ions, particularly multivalent cations and sulfate ions, from the water. The water processing system may also be comprised of a boiler 210 that is operatively fluidly coupled to the water purification unit 202 via line 214 to receive purified water from the water purification unit. The boiler 210 may be configured to produce high quality steam having a vapor quality of from 0.7 to 1.0, or to produce low quality steam having a vapor quality of from greater than 0.3 to less than 0.7 from the purified water produced by the water purification unit, where the steam may be exported from the water processing system 120 via line 216.

The separation unit 122 of the processing facility 110 may be designed to separate oil, water, and at least a portion of the oil recovery formulation produced from the formation. The separation unit 122 may be comprised of a water knockout vessel 230 and a flash or distillation unit 232. The water knockout vessel 230 of the separation unit 122 may be operatively fluidly coupled to the second well by conduit 234 to receive oil, water, and oil recovery formulation produced from the formation via the second well. The produced oil and produced oil recovery formulation may be separated from produced water in the water knockout vessel 230, where the separated produced water may be exported from the water knockout vessel and separation unit 122 through conduit 244. Oil/water separation aids such as a demulsifier and/or a brine solution may be provided to the water knockout vessel through inlet 240 to aid in the separation of the produced oil and produced oil recovery formulation from the produced water. The produced oil and produced oil recovery formulation may be provided from the water knockout vessel 230 to the flash or distillation unit 232 via conduit 238. The produced oil recovery formulation may be separated from the produced oil in the flash or distillation unit, where the flash or distillation unit may be operated at a temperature of from 40° C. to 80° C. and/or at a reduced pressure of from 0.01 MPa to 0.09 MPa to separate the oil recovery formulation from the produced oil. The produced oil recovery formulation may include components of the produced oil that have a boiling point at or near the boiling point of DMS or that form azeotropic mixtures with DMS, as described above. The produced oil may be exported from the flash or distillation unit 232 and the separation unit 122 through conduit 242, and the produced oil recovery formulation may be exported from the flash or distillation unit 232 and the separation unit 122 through conduit 236.

Referring back to FIGS. 1 and 2, the first well 132 and the second well 112 extend from the surface 140 into one or more of the oil-bearing portions 104, 106, and 108 of the subterranean oil-bearing formation 105. A subsurface portion 142 of the first well 132 and a subsurface portion 144 of the second well 112 may traverse one or more oil-bearing portions of the formation 105. The subsurface portion 144 of the second, producing, well 112 may be located below the subsurface portion 142 of the first, injecting, well 132. The subsurface portions 142 and 144 of the first and second wells 132 and 112, respectively, may be positioned transverse to portions 146 and 148 of the first and second wells 132 and 112, respectively, that extend from the surface 140 to the respective subsurface portions 142 and 144 of the wells. The subsurface portion 142 of the first well 132 and the subsurface portion 144 of the second well 112 may extend horizontally through the formation, and the horizontally extending subsurface portion 144 of the second well 112 may extend substantially parallel to and below the horizontally extending subsurface portion 142 of the first well 132.

The vertical spacing between the horizontal subsurface portion 142 of the first well 132 and the horizontal subsurface portion 144 of the second well 112 may be from 2 meters to 150 meters, or from 5 meters to 100 meters. The horizontal subsurface portion 142 of the first well 132 and the horizontal subsurface portion 144 of the second well 112 may have a length of from 25 meters to 2000 meters, or from 50 meters to 1000 meters, or from 100 meters to 500 meters. The horizontal subsurface portion 144 of the second well 112 is preferably as long as, or longer than, the horizontal subsurface portion 142 of the first well 132.

As shown in FIG. 1, a toe section 150 of the subsurface portion 142 of the first well 132 may be aligned with a heel section 152 of the subsurface portion 144 of the second well. Alternatively, as shown in FIG. 2, a heel section 154 of the subsurface portion 142 of the first well 132 may be aligned with the heel section 152 of the subsurface portion 144 of the second well 112. Referring again to FIGS. 1 and 2, although the wells 132 and 112 are shown with an abrupt right angle transition from vertical to horizontal, in some embodiments wells 132 and 112 may have a smooth transition from vertical to deviated to horizontal, for example with a smooth curved radius.

Referring now to FIGS. 1, 2, and 3, in a process of the present invention the oil recovery formulation comprising at least 15 mol % DMS is introduced into one or more oil-bearing portions 104, 106, or 108 of the oil-bearing formation 105 comprising heavy oil or bitumen through the first, injecting, well 132 together with steam. The oil recovery formulation and the steam may be introduced into the formation by injecting the oil recovery formulation and the steam into the formation 105 through one or more perforations in the first well 132. The oil recovery formulation may be provided to the first well 132 for introduction into the formation from an oil recovery formulation storage facility 130 that is operatively fluidly coupled to the first well via conduit 129 to provide the oil recovery formulation to the first well. Steam may be provided to the first well 132 for introduction into the formation along with the oil recovery formulation by providing source water from the water storage facility 116 to the water processing unit 120 of the processing facility 110 via conduit 212, where particulates and ions are removed from the source water in the water purification unit 202, steam is formed in the boiler 210 from the purified water, and the steam is provided to the first well via conduit 216.

The oil recovery formulation is introduced into the formation together with the steam, where the oil recovery formulation comprises at least 5 wt. % of the total weight of the combined oil recovery formulation and the steam introduced together into the formation. The oil recovery formulation may comprise at least 15 wt. %, or at least 20 wt. %, or from 5 wt. % to 80 wt. %, or from 10 wt. % to 75 wt. % of the total weight of the combined oil recovery formulation and the steam introduced together into the formation. Sufficient steam should be introduced into the formation together with the oil recovery formation to vaporize at least a portion of the DMS in the oil recovery formation or to provide sufficient heat to render supercritical at least a portion of the DMS in the oil recovery formulation. Sufficient steam may be introduced into the formation to heat a portion of the formation and thereby reduce the viscosity of a portion of the oil in the formation, where the heat provided by the steam may be sensible heat and latent heat.

The oil recovery formulation and the steam may be co-injected into the formation 105 through the subsurface portion 142 of the first well 132. The subsurface portion 142 of the first well 132 may have perforations or openings along the length of the portion 142 through which the oil recovery formulation and steam may be injected into the formation.

The oil recovery formulation and steam may be injected into the formation 105 under sufficient pressure to introduce the oil recovery formulation and steam into the formation. The oil recovery formulation may be injected into the formation at a pressure above the initial pressure of the formation at the injection point, and may be injected at a pressure ranging from immediately above the initial pressure of the formation up to the critical pressure of steam (22.1 MPa) or up to the critical pressure of DMS (5.7 MPa).

The oil recovery formulation and steam may be injected into the formation 105 at a temperature sufficient to vaporize the DMS or to render the DMS supercritical at the instantaneous formation pressure, where the temperature of the combined oil recovery formulation and steam may be controlled by controlling the temperature of the steam. The temperature of the steam may be controlled by producing steam of a desired temperature from the boiler as conventional in the art. The steam temperature may be controlled to be from 100° C. to 350° C., or from 200° C. to 300° C., or at most 300° C., or at most 250° C., or at most 225° C.

The temperature and pressure of the combined oil recovery formulation and the steam introduced into the formation may be controlled so that the DMS of the oil recovery formulation may be introduced into the formation as a vapor or as a supercritical fluid in accordance with the temperature and pressure phase diagram of DMS as known in the art. DMS may be introduced into the formation as a vapor to enhance penetration of the oil recovery formulation into the formation, or DMS may be introduced into the formation as a supercritical fluid to improve the sweep of the oil recovery formulation through the formation.

Upon injection of the oil recovery formulation and steam into the formation 105, the oil recovery formulation and steam may contact oil within the formation. Contacting the oil recovery formulation and steam with oil in the formation may reduce the viscosity of the oil by heating the oil with the sensible heat and the latent heat of condensation of the steam and by DMS contacting and mixing with the oil to reduce the viscosity of the oil.

The oil in the formation may be mobilized for production by contact with the oil recovery formulation and steam introduced into the formation. The reduction of the oil viscosity by exchange of thermal energy with the steam and/or by mixing with the oil recovery formulation, in particular the DMS, may mobilize the oil contacted by the steam and the oil recovery formulation relative to oil initially present in the formation. The mobilized reduced viscosity oil may be freed to fall toward the second, production, well 112, from which the mobilized oil may be produced from the formation. A portion of the oil recovery formulation, including DMS, also may be produced from the formation as a mixture with the mobilized oil.

In one embodiment of the process of the present invention, steam, or a combination of steam and the oil recovery formulation, may be introduced into the formation to form a steam chamber 170 in the formation 105, and after formation of the steam chamber, the oil recovery formulation and steam may be introduced into the formation through the steam chamber to mobilize and recover oil from the formation. The steam chamber may be formed by injecting steam, or the oil recovery formulation together with steam, into the formation through the first well 132 and the second well 112. The steam provided from the water processing system for injection into the formation to form the steam chamber is preferably high quality steam having a vapor quality of from 0.7 to 1.0, preferably from 0.85 to 1.0, to provide substantial thermal energy to the formation to reduce the viscosity of the oil in the formation around the first and second wells. The injected steam optionally together with the oil recovery formulation reduces the viscosity of oil in the immediate vicinity of the first well 132 and the second well 112. Injection may be stopped from the second well 112 and reduced viscosity mobilized oil may be produced from the second well. The steam and optionally the oil recovery formulation may be injected again through the second well 112 after recovery of the mobilized oil to reduce the viscosity and mobilize more oil in the formation, and then the additional reduced viscosity mobilized oil may be recovered from the second well. Injection of steam, optionally together with the oil recovery formulation, through the first and second wells 132 and 112 and production of mobilized oil from the second well may be continued in this manner until a steam chamber 170 is formed in the formation. Thereafter, the oil recovery formulation and the steam may be injected together into the formation through the first well 132 and mobilized oil may be produced from the second well.

The temperature and pressure of the combined oil recovery formulation and steam that are injected into the steam chamber 170 through the first well may be controlled to provide the DMS in the oil recovery formulation to the formation in vapor phase while providing steam having a vapor quality of from 0.7 to 1.0 from the water processing system for introduction to the formation as high quality steam. The high quality steam may pass substantially through the steam chamber 170 as vapor and condense at the oil/steam chamber interface at the edge of the steam chamber, providing the latent heat of condensation of the steam to oil at the edge of the steam chamber, and thereby mobilizing the oil. The DMS from the oil recovery formulation may also pass substantially through the steam chamber as a vapor and penetrate the edge of the steam chamber to condense and mix with oil outside the steam chamber, thereby reducing the viscosity of the oil and mobilizing the oil. The oil mobilized by the steam and by mixing with the oil recovery formulation may fall through the formation for production from the formation through the second well, enlarging the steam chamber and exposing more oil for production by contact with the steam and the oil recovery formulation.

The process of the present invention may also comprise forming a steam chamber 170 in the formation 105; introducing the oil recovery formulation together with steam into the steam chamber 170; and recovering residual oil from the steam chamber after introducing the oil recovery formulation together with steam into the steam chamber. The steam chamber 170 may be formed by injecting steam or a combination of steam and the oil recovery formulation into the formation as described above for a first period of time. The resulting steam chamber has a reduced quantity of oil therein (the "residual oil") relative to the amount of oil present in the formation at the boundary of the steam chamber and portions of the formation outside of the steam chamber.

The oil recovery formulation together with steam may be injected into the steam chamber 170 through the subsurface portion 142 of the first well 132 for a second time period, where the second time period commences after the first time period ends. The temperature and pressure of the combined oil recovery formulation and steam that are injected into the steam chamber 170 through the first well may be controlled to provide the DMS in the oil recovery formulation to the formation as a supercritical fluid while optionally providing steam having a vapor quality of from 0.3 to less than 0.7 from the water processing system for introduction to the formation as low quality steam. The oil recovery formulation may contact the residual oil in the steam chamber 170 and mobilize the residual oil as described above, where supercritical DMS has a density greater than vapor phase DMS and may more effectively sweep the steam chamber for contact and mixing with residual oil in the steam chamber than vapor phase DMS. The low quality steam may provide latent heat of condensation to the residual oil, also reducing the viscosity of the residual oil and mobilizing the residual oil. The mobilized residual oil may fall from the steam chamber 170 to the second well 112 for production from the formation.

The mobilized oil, water, and oil recovery formulation may be produced from the formation through the second well 112 by conventional oil production processes. The well 112 may include conventional mechanisms for producing oil from a formation, including lift pumps, lift gases, and/or a compressor for injecting gas into the formation to produce the oil, water, and oil recovery formulation from the formation.

The oil, water, and oil recovery formulation produced from the formation through the second well 112 may be processed and separated. The second well 112 may be operatively fluidly coupled to the water knockout vessel 230 of the separation unit 122 via conduit 234. As described above, the produced oil, produced oil recovery formulation, and produced water may be separated in the separation unit 122. The separated produced oil may be provided from the flash or distillation unit 232 of the separation unit to the oil storage facility 134 via conduit 242. The separated produced water may be provided from the water knockout vessel 230 of the separation unit 122 to the water storage facility 116 via conduit 244. The separated oil recovery formulation may be provided from the flash or distillation unit 232 to the oil recovery formulation storage facility 130 via conduit 236.

The separated produced oil recovery formulation may be introduced again into the formation together with steam to mobilize further oil for recovery from the formation, thereby cycling the oil recovery formulation through the formation. The separated produced oil recovery formulation may comprise additional hydrocarbons relative to the oil recovery formulation initially introduced into the formation. Hydrocarbons that have a boiling point near the boiling point of DMS or that form azeotropic mixtures with DMS may be separated from the produced oil in the flash or distillation. In particular, pentane, isopentane, 2-methyl-2-butene, and isoprene may be separated with DMS from the produced oil.

Figure 4:
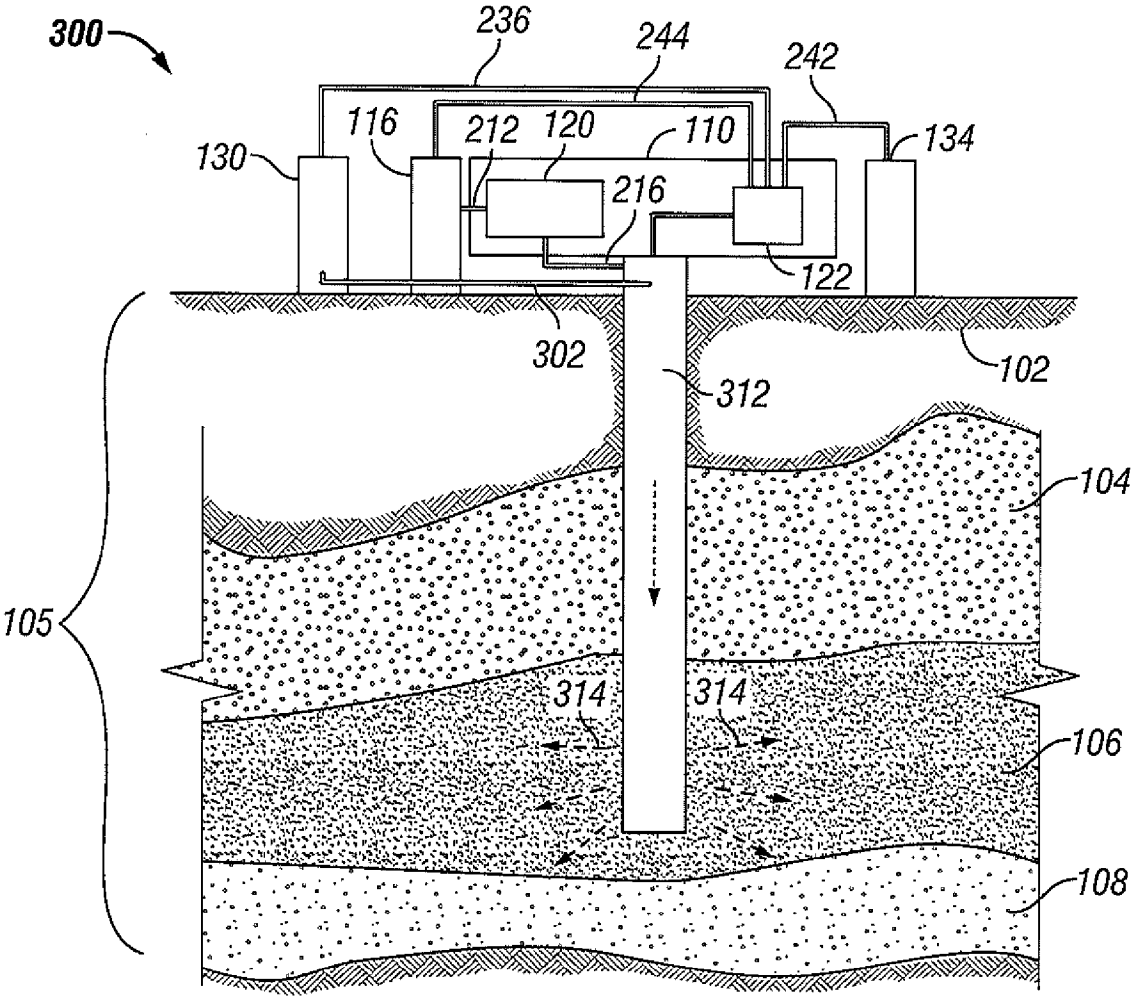
FIG. 4 illustrates an oil production system that may be used to practice the process of the present invention, depicting an oil recovery formulation being injected into an oil-bearing formation.
Figure 5:
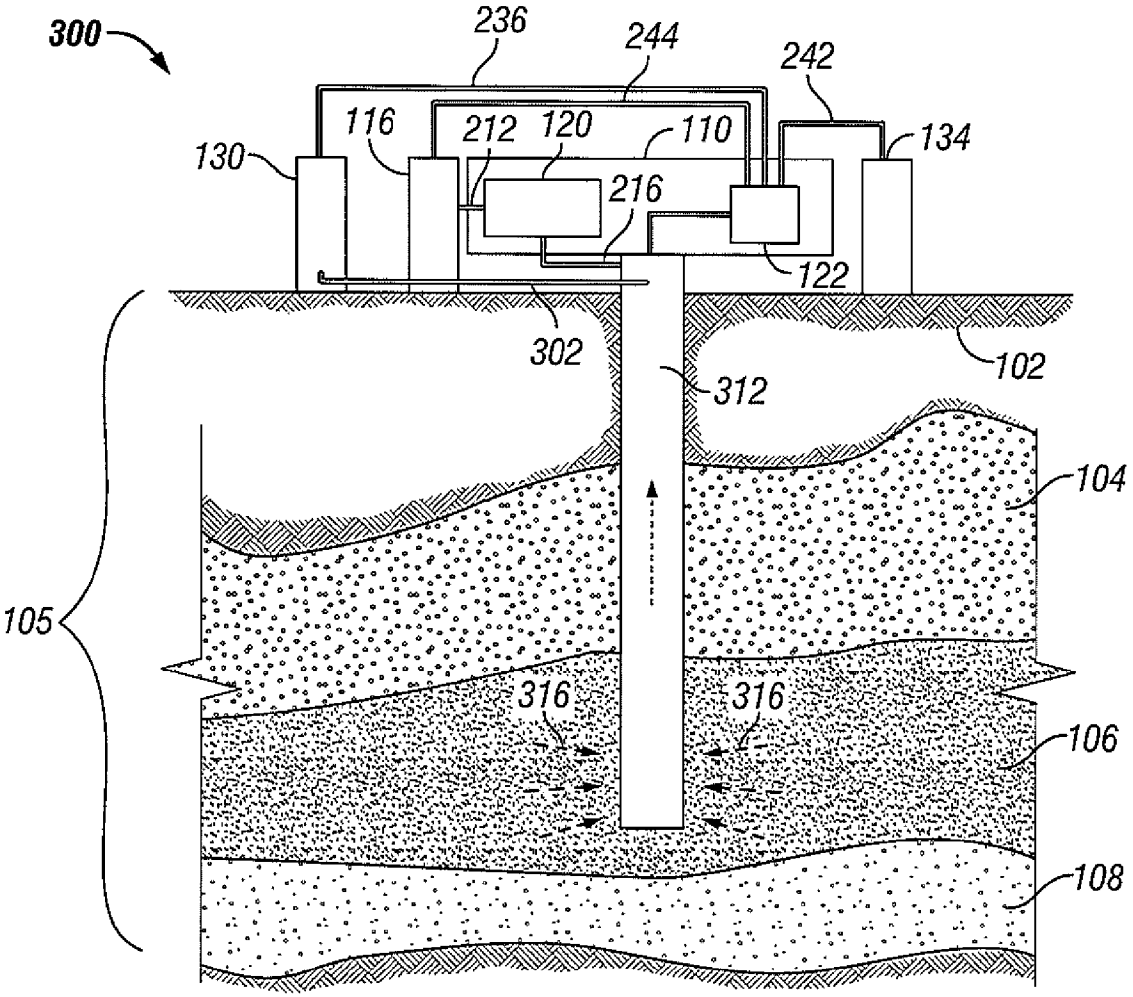
FIG. 5 illustrates an oil production system that may be used to practice the process of the present invention, depicting production of oil from the formation.

The process of the present invention may also be utilized in a cyclic steam stimulation ("CSS") oil recovery process. Referring now to FIGS. 4 and 5, an oil production system utilizing a single well for injection and production according to a CSS process in accordance with the process of the present invention is shown. The system 300 may be similar in some respects to the system 100 described above with reference to FIGS. 1 and 2 and with the processing facility of FIG. 3. Accordingly, the system 300 may be understood with reference to FIGS. 1, 2, and 3, where like numerals are used to indicate like components that will not be described again in detail.

Referring now to FIG. 4, steam or hot water having a temperature of at least 80° C. and an oil recovery formulation comprising at least 15 mol % DMS may be provided. The oil recovery formulation and steam or hot water may be injected together into a formation 105 through well 312. The oil recovery formulation may be provided to the well 312 from an oil recovery formulation storage facility 130 via conduit 302. Steam may be provided to the well 312 via a conduit 216 from a water processing system 120 including a water purification system and a boiler for producing steam or water having a temperature of at least 80° C., or from 80° C. to 100° C., from water provided from a water storage facility 116.

The oil recovery formulation and the steam or hot water may be injected together into the formation 105 through the well 312 to contact and mix with oil in the formation, as shown by arrows 314. The oil recovery formulation may reduce the viscosity of the oil upon contact with the oil, as described above, and thereby mobilize the oil for recovery from the formation. The steam or hot water may also reduce the viscosity of the oil by providing thermal energy to the oil as described above, mobilizing the oil for recovery from the formation.

The oil recovery formulation and the steam or hot water may be injected into the formation through the well 312 for a first period of time after which injection of the oil recovery formulation and steam or hot water may be ceased. The oil recovery formulation may be allowed to soak in the formation to mix with the oil therein and reduce the viscosity of the oil and mobilize the oil after cessation of injection of the oil recovery formulation and steam or hot water into the formation. Steam may be allowed to condense in the formation and/or hot water may be allowed to soak in the formation to provide thermal energy to the oil therein to reduce the viscosity of the oil and mobilize the oil after cessation of injection of the oil recovery formulation and steam or hot water into the formation.

Then, as shown in FIG. 5, the mobilized oil, water, and the oil recovery formulation may be produced from the formation through the well 312 for a second time period, where the second time period commences after the end of the first time period, and preferably after the oil recovery formulation, and optionally hot water, has been allowed to soak in the formation, and steam has been allowed to condense in the formation. The mobilized oil, water, and oil recovery formulation may be drawn through the formation as shown by arrows 316 for production from the well. The well 312 may include conventional mechanisms for producing oil from a formation, including lift pumps, lift gases, and/or a compressor for injecting gas into the formation to produce the oil, water, and oil recovery formulation from the formation.

The oil, water, and oil recovery formulation produced from the well 312 may be separated in the processing facility 110 and stored as described above. The separated produced oil recovery formulation may be introduced into the formation again together with steam or hot water as described above.

In one embodiment of a CSS process in accordance with the process of the present invention, prior to injecting the oil recovery formulation into the formation and subsequently recovering mobilized oil, water, and the oil recovery formulation therefrom, high quality steam having a vapor quality of at least 0.7, or at least 0.9, may be produced by the water processing system and provided for injection into the formation 105 through well 312 to contact and mix and soak with oil in the formation to mobilize the oil, and then the mobilized oil may be recovered through well 312. The cycle of injection of high quality steam into the formation; contacting, mixing, and soaking the high quality steam with the oil to mobilize the oil, and recovery of the mobilized oil from the well may be effected two or more times prior to injecting the oil recovery formulation together with steam or hot water into the formation; contacting, mixing, and soaking the oil recovery formulation and steam or hot water with oil in the formation to mobilize the oil in the formation; and recovering the mobilized oil from the well through which the oil recovery formulation and steam or hot water were injected into the formation. Use of the oil recovery formulation and steam or hot water together as described above after CSS oil recovery using high quality steam enables recovery of residual oil in the formation.

Figure 6:
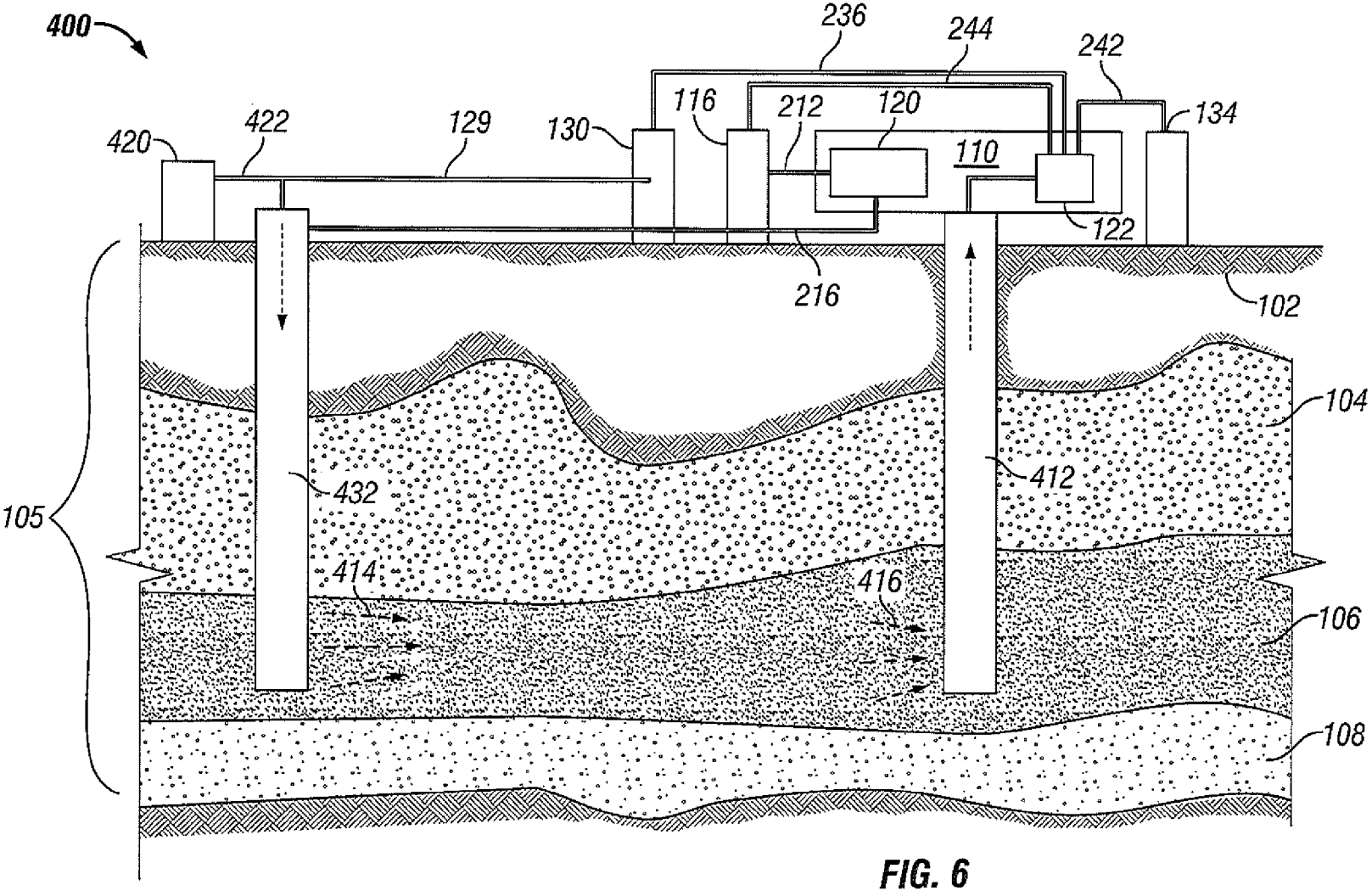
FIG. 6 illustrates an oil production system that may be used to practice the process of the present invention.

The process of the present invention may also be utilized in a vertical steam drive ("VSD") oil recovery process. Referring now to FIG. 6, an oil production system 400 is illustrated that may be used to practice one or more embodiments of a vertical steam drive (VSD) process in accordance with the process of the present invention. The system may be similar in some respects to the system 100 described above with respect to FIGS. 1 and 2 and the processing facility 110 as shown in FIG. 3. Accordingly, the system 400 may be understood with reference to FIGS. 1, 2, and 3, where like numerals are used to indicate like components that will not be described again in detail.

Referring now to FIG. 6, oil recovery formulation comprising at least 15 mol % DMS and steam or hot water having a temperature of at least 80° C. are provided for introduction into a formation 105 through a first well 432. The oil recovery formulation may be provided to the first well 432 from an oil recovery formulation storage facility 130 via conduit 129, and steam or hot water may be provided to the first well via conduit 216 from a water processing system 120 including a water purification system and a boiler for producing steam or water having a temperature of at least 80° C. from water provided from a water storage facility 116.

The oil recovery formulation and steam or hot water may be introduced together into the formation 105 through the first well 432 to contact and mix with oil, as described above, and thereby mobilize the oil for recovery from the formation. The steam or hot water may reduce the viscosity of the oil upon contact by providing thermal energy to the oil, as described above, and thereby mobilize the oil for recovery from the formation 105. The oil recovery formulation may reduce the viscosity of the oil by mixing with the oil, as described above, thereby mobilizing the oil for production from the formation. The steam or hot water may also provide thermal energy for vaporizing the DMS of the oil recovery formulation within the formation, wherein the vaporized DMS may penetrate the formation and then condense and mix with oil in the formation to mobilize the oil.

The volume of the oil recovery formulation and steam or hot water introduced into the formation 105 via the first well 432 may range from 0.001 to 10 pore volumes, or from 0.01 to 5 pore volumes, or from 0.1 to 2 pore volumes, or from 0.2 to 1 pore volumes, where the term "pore volume" refers to the volume of the formation that may be swept by the oil recovery formulation and steam or hot water between the first well 432 and the second well 412. The pore volume may be readily determined by methods known to a person skilled in the art, for example by modelling studies or by injecting water having a tracer contained therein through the formation 105 from the first well 432 to the second well 412.

The mobilized oil may be pushed across the formation 105 from the first well 432 to the second well 412 as shown by arrows 414 and 416 by further introduction of more oil recovery formulation and steam or hot water into the formation or by introduction of an oil immiscible drive fluid into the formation subsequent to injection of the oil recovery formulation and steam or hot water into the formation.

The oil immiscible drive fluid may be introduced into the formation 105 through the first well 432 to force or otherwise displace the mobilized oil toward the second well 412 for production. The oil immiscible drive fluid may be configured to displace the mobilized oil through the formation 105. Suitable oil immiscible drive fluids are not first contact miscible or multiple contact miscible with oil in the formation 105. The oil immiscible drive fluid may be selected from the group consisting of an aqueous polymer fluid, water, carbon dioxide at a pressure below its minimum miscibility pressure, nitrogen at a pressure below its minimum miscibility pressure, air, and mixtures of two or more of the preceding.

Suitable polymers for use in an aqueous polymer fluid may include, but are not limited to, polyacrylamides, partially hydrolyzed polyacrylamides, polyacrylates, ethylenic copolymers, biopolymers, carboxymethylcellulose, polyvinyl alcohols, polystyrene sulfonates, polyvinylpyrolidones, AMPS (2-acrylamide-2-methyl propane sulfonate), combinations thereof, or the like. Examples of ethylenic copolymers include copolymers of acrylic acid and acrylamide, acrylic acid and lauryl acrylate, lauryl acrylate and acrylamide. Examples of biopolymers include xanthan gum, guar gum, alginates, and alginic acids and their salts. In some embodiments, polymers may be crosslinked in situ in the formation 105. In other embodiments, polymers may be generated ex situ and then injected into the formation 105 in an aqueous solution.

The oil immiscible drive fluid may be stored in, and provided for introduction into the formation 105 from, an oil immiscible drive fluid storage facility 420 that may be operatively fluidly coupled to the first well 432 via conduit 422. The amount of oil immiscible drive fluid introduced into the formation 105 should be sufficient to drive the mobilized oil across at least a portion of the formation, and preferably is at least 0.2 pore volumes or at least 0.5 pore volumes, or at least 1 pore volume as measured between the first well 432 and the second well 412.

If the oil immiscible drive fluid is in liquid phase, the oil immiscible drive fluid may have a viscosity of at least the same magnitude as the viscosity of the mobilized oil at formation temperature conditions to enable the oil immiscible drive fluid to drive the mobilized oil across the formation 105 to the second well 412. The oil immiscible formulation may have a viscosity of at least 0.8 mPa s (0.8 cP) or at least 10 mPa s (10 cP), or at least 50 mPa s (50 cP), or at least 100 mPa s (100 cP), or at least 500 mPa s (500 cP), or at least 1000 mPa s (1000 cP), or at least 10000 mPa s (10000 cP) at 25° C. If the oil immiscible drive fluid is in liquid phase, preferably the oil immiscible drive fluid may have a viscosity at least one order of magnitude greater than the viscosity of the mobilized oil at formation temperature conditions so the oil immiscible drive fluid may drive the mobilized oil across the formation in plug flow, minimizing and inhibiting fingering of the mobilized oil through the driving plug of oil immiscible formulation.

The oil recovery formulation together with steam or hot water and the oil immiscible drive fluid may be introduced into the formation 105 through the first well 432 in alternating slugs. For example, the oil recovery formulation together with steam or hot water may be introduced into the formation 105 through the first well 432 for a first time period, after which the oil immiscible drive fluid may be introduced into the formation through the first well for a second time period subsequent to the first time period, after which the oil recovery formulation together with steam or hot water may be introduced into the formation through the first well for a third time period subsequent to the second time period, after which the oil immiscible drive fluid may be introduced into the formation through the first well for a fourth time period subsequent to the third time period. As many alternating slugs of the oil recovery formulation together with steam or hot water and the oil immiscible drive fluid may be introduced into the formation through the first well as desired.

Oil may be mobilized for production from the formation 105 via the second well 412 by introduction of the oil recovery formulation together with steam or hot water and, optionally, the oil immiscible drive fluid into the formation, where the mobilized oil is driven through the formation for production from the second well as indicated by arrows 416 by introduction of the oil recovery formulation together with steam or hot water and optionally the oil immiscible drive fluid into the formation via the first well 432.

The mobilized oil, water, and oil recovery formulation may be produced from the formation 105 through the second well 412 by conventional oil production processes. The well 412 may include conventional mechanisms for producing oil from a formation, including lift pumps, lift gases, and/or a compressor for injecting gas into the formation to produce the oil, water, and oil recovery formulation from the formation. Oil, water and the oil recovery formulation produced from the formation may be processed, separated, and stored as described above. Produced and separated oil recovery formulation may be reintroduced into the formation together with steam or hot water, cycling the oil recovery formulation through the formation to reduce the total quantity of oil recovery formulation utilized to recover oil from the formation.

In an embodiment of a VSD process in accordance with the process of the present invention, the first well 432 may be used for introducing the oil recovery formulation together with steam or hot water and, optionally, subsequently the oil immiscible drive fluid into the formation 105 and the second well 412 may be used for producing oil, water, and the oil recovery formulation from the formation for a first time period; then the second well 412 may be used for introducing the oil recovery formulation together with steam or hot water and, optionally, subsequently the oil immiscible drive fluid into the formation 105 and the first well 432 may be used for producing oil, water, and the oil recovery formulation from the formation for a second time period; where the first and second time periods comprise a cycle. Multiple cycles may be conducted which include alternating the first well 432 and the second well 412 between introducing the oil recovery formulation together with steam or hot water and, optionally, subsequently the oil immiscible drive fluid into the formation 105, and producing oil, water, and the oil recovery formulation from the formation, where one well is introducing and the other is producing for the first time period, and then they are switched for a second time period. A cycle may be from about 12 hours to about 1 year, or from about 3 days to about 6 months, or from about 5 days to about 3 months. The oil recovery formulation together with steam or hot water may be introduced into the formation at the beginning of a cycle and the oil immiscible drive fluid may be introduced at the end of the cycle. In some embodiments, the beginning of a cycle may be the first 10% to about 80% of a cycle, or the first 20% to about 60% of a cycle, the first 25% to about 40% of a cycle, and the end may be the remainder of the cycle.

In one embodiment of a VSD process in accordance with the process of the present invention, a fluid flow path between the first well 432 and the second well 412 may be established prior to introducing the steam or hot water together with the oil recovery formulation comprising at least 15 mol % DMS into the formation since unconsolidated sand and the viscous crude oil of the formation may impede injection of the oil recovery formulation and steam or hot water into the formation. A fluid flow path may be established in the formation 105 by injecting steam into the formation or by hydraulic fracturing. Steam may be injected to establish a fluid flow path if the injection path from the first well 432 in the formation 105 is located in a water saturated zone of the formation. Any asphaltic or other hydrocarbon materials located in the water saturated zone may be mobilized by the steam, opening a fluid flow path. Alternatively, or in conjunction with injection of steam into the formation 105, hydraulic fracturing may be utilized to establish a fluid flow path from the first well 432 into the formation, particularly in hydrocarbon saturated zones of the formation, where the first well may include a mechanism for hydraulic fracturing of the formation. Hydraulic fracturing may be effected in accordance with well known hydraulic fracturing techniques. Once a fluid flow path has been established in the formation 105, a propping agent may be injected into the flow path to prevent the flow path from closing, where the well may have a mechanism for injecting a propping agent into an established fluid flow path. Gravel and sand or mixtures thereof may be utilized as propping agents, where the propping agent may have a wide distribution of particle sizes to prevent the tar sand materials in the formation from flowing into and closing the fluid flow path.

The steam or hot water together with the oil recovery formulation then may be introduced into the formation 105 through the first well 432 into the established flow path. The DMS in the oil recovery formulation may vaporize due to the thermal energy provided by the steam or hot water and move upward from the flow path into the formation where it may condense and mix with oil to reduce the viscosity of the oil and thereby mobilize the oil. The mobilized oil may fall into the flow path and be driven along the flow path for production from the second well 412. In an embodiment, alternating slugs of the oil recovery formulation together with steam or hot water and an oil immiscible formulation as described above are injected into the flow path from the first well, where the oil immiscible formulation may drive the mobilized oil along the flow path for production from the second well.

EXAMPLE 1

The quality of dimethyl sulfide as an oil recovery agent based on the miscibility of dimethyl sulfide with a crude oil relative to other compounds was evaluated. The miscibility of dimethyl sulfide, ethyl acetate, o-xylene, carbon disulfide, chloroform, dichloromethane, tetrahydrofuran, and pentane solvents with Muskeg River mined oil sands was measured by extracting the oil sands with the solvents at 10° C. and at 30° C. to determine the fraction of hydrocarbons extracted from the oil sands by the solvents. The bitumen content of the Muskeg River mined oil sands was measured at 11 wt. % as an average of bitumen extraction yield values for solvents known to effectively extract substantially all of bitumen from oil sands—in particular chloroform, dichloromethane, o-xylene, tetrahydrofuran, and carbon disulfide. One oil sands sample per solvent per extraction temperature was prepared for extraction, where the solvents used for extraction of the oil sands samples were dimethyl sulfide, ethyl acetate, o-xylene, carbon disulfide, chloroform, dichloromethane, tetrahydrofuran, and pentane. Each oil sands sample was weighed and placed in a cellulose extraction thimble that was placed on a porous polyethylene support disk in a jacketed glass cylinder with a drip rate control valve. Each oil sands sample was then extracted with a selected solvent at a selected temperature (10° C. or 30° C.) in a cyclic contact and drain experiment, where the contact time ranged from 15 to 60 minutes. Fresh contacting solvent was applied and the cyclic extraction repeated until the fluid drained from the apparatus became pale brown in color.

The extracted fluids were stripped of solvent using a rotary evaporator and thereafter vacuum dried to remove residual solvent. The recovered bitumen samples all had residual solvent present in the range of from 3 wt. % to 7 wt. %. The residual solids and extraction thimble were air dried, weighed, and then vacuum dried. Essentially no weight loss was observed upon vacuum drying the residual solids, indicating that the solids did not retain either extraction solvent or easily mobilized water. Collectively, the weight of the solid or sample and thimble recovered after extraction plus the quantity of bitumen recovered after extraction divided by the weight of the initial oil sands sample plus the thimble provide the mass closure for the extractions. The calculated percent mass closure of the samples was slightly high because the recovered bitumen values were not corrected for the 3 wt. % to 7 wt. % residual solvent. The extraction experiment results are summarized in Table 1.

TABLE 1

Summary of Extraction Experiments of Bituminous Oil Sands with Various Fluids

| Extraction Fluid | Temperature, C. | Input Solids weight, g | Output Solids weight, g | Weight Change, g | Recovered Bitumen, g | Experimental Weight Closure, % |
|---|---|---|---|---|---|---|
| Carbon Disulfide | 30 | 151.1 | 134.74 | 16.4 | 16.43 | 100.0 |
| Carbon Disulfide | 10 | 151.4 | 134.62 | 16.8 | 16.62 | 99.9 |
| Chloroform | 30 | 153.7 | 134.3 | 19.4 | 18.62 | 99.5 |
| Chloroform | 10 | 156.2 | 137.5 | 18.7 | 17.85 | 99.5 |

TABLE 1-continued

Summary of Extraction Experiments of Bituminous Oil Sands with Various Fluids

| Extraction Fluid | Temperature, C. | Input Solids weight, g | Output Solids weight, g | Weight Change, g | Recovered Bitumen, g | Experimental Weight Closure, % |
|---|---|---|---|---|---|---|
| Dichloromethane | 30 | 155.8 | 138.18 | 17.7 | 16.30 | 99.1 |
| Dichloromethane | 10 | 155.2 | 136.33 | 18.9 | 17.66 | 99.2 |
| o-Xylene | 30 | 156.1 | 136.58 | 19.5 | 17.37 | 98.6 |
| o-Xylene | 10 | 154.0 | 136.66 | 17.3 | 17.36 | 100.0 |
| Tetrahydrofuran | 30 | 154.7 | 136.73 | 18.0 | 17.67 | 99.8 |
| Tetrahydrofuran | 10 | 154.7 | 136.98 | 17.7 | 16.72 | 99.4 |
| Ethyl Acetate | 30 | 153.5 | 135.81 | 17.7 | 11.46 | 96.0 |
| Ethyl Acetate | 10 | 155.7 | 144.51 | 11.2 | 10.32 | 99.4 |
| Pentane | 30 | 154.0 | 139.11 | 14.9 | 13.49 | 99.1 |
| Pentane | 10 | 152.7 | 138.65 | 14.1 | 13.03 | 99.3 |
| Dimethyl Sulfide | 30 | 154.2 | 137.52 | 16.7 | 16.29 | 99.7 |
| Dimethyl Sulfide | 10 | 151.7 | 134.77 | 16.9 | 16.55 | 99.7 |

Figure 7:
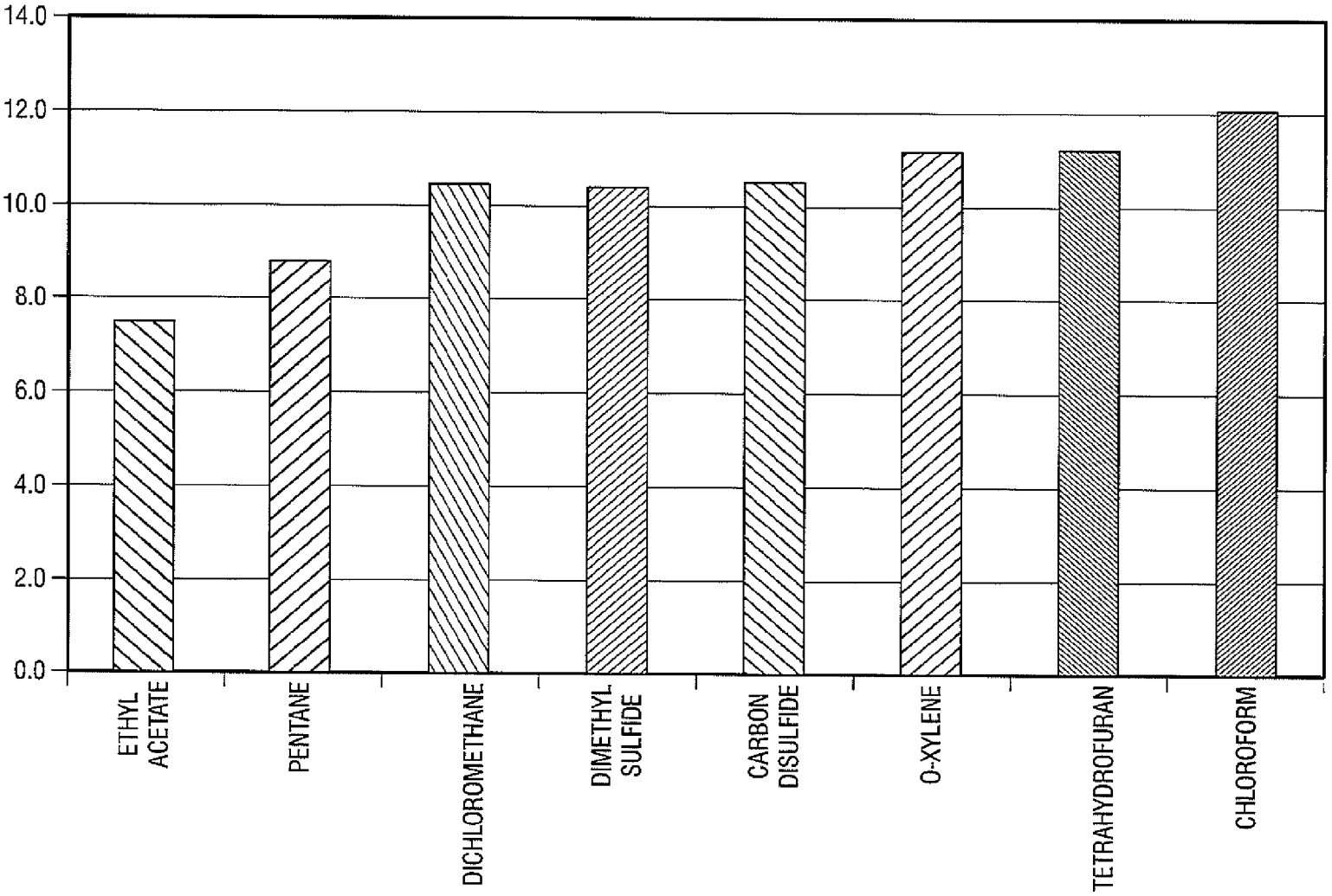
FIG. 7 is a graph showing petroleum recovery from oil sands at 30° C. using various solvents.
Figure 8:
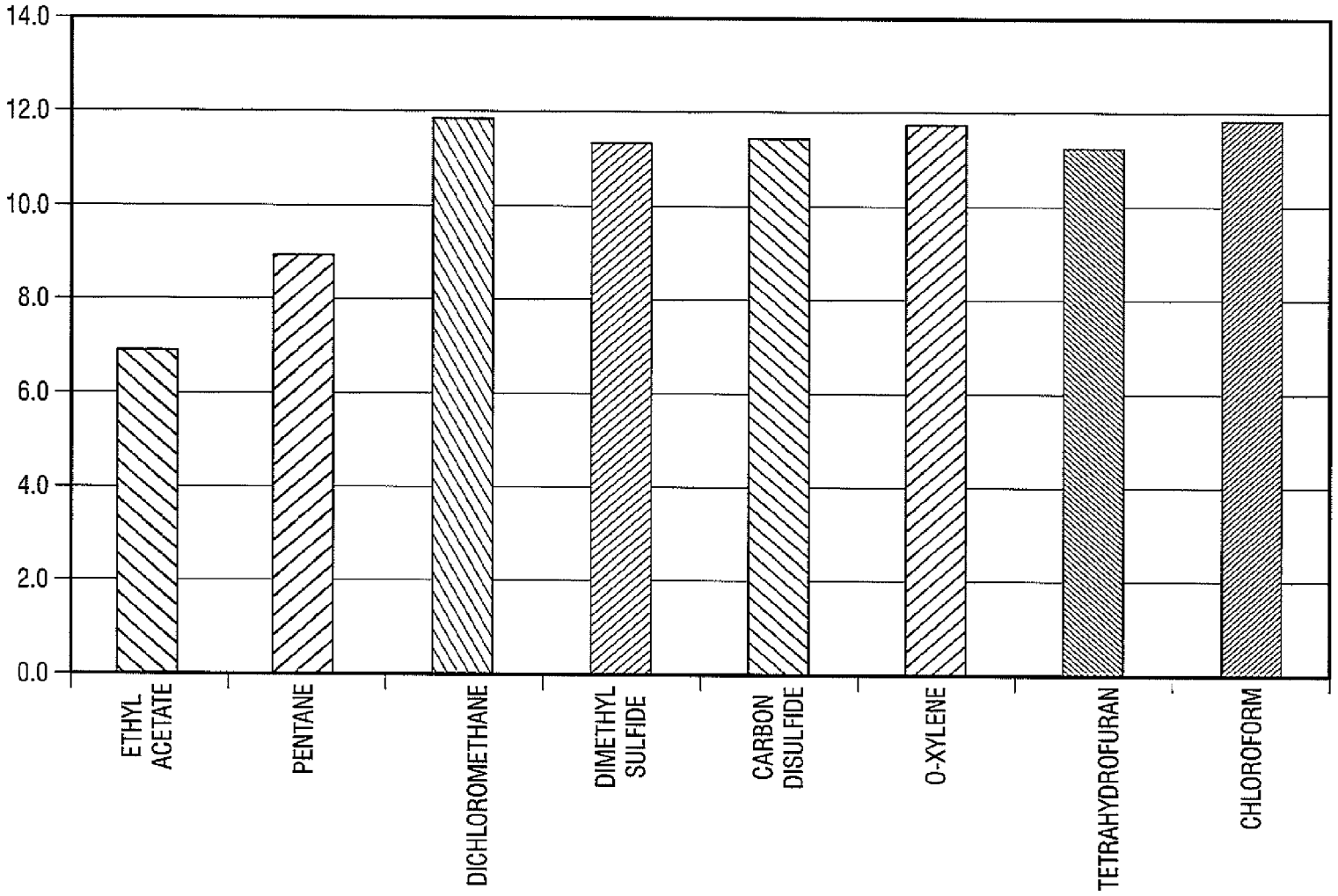
FIG. 8 is a graph showing petroleum recovery from oil sands at 10° C. using various solvents.

FIG. 7 provides a graph plotting the weight percent yield of extracted bitumen as a function of the extraction fluid at 30° C. applied with a correction factor for residual extraction fluid in the recovered bitumen, and FIG. 8 provides a similar graph for extraction at 10° C. FIGS. 7 and 8 and Table 1 show that dimethyl sulfide is comparable for recovering bitumen from an oil sand material with the best known fluids for recovering bitumen from an oil sand material—o-xylene, chloroform, carbon disulfide, dichloromethane, and tetrahydrofuran—and is significantly better than pentane and ethyl acetate.

The bitumen samples extracted at 30° C. by each solvent were evaluated by SARA analysis to determine the saturates, aromatics, resins, and asphaltenes composition of the bitumen. The results are shown in Table 2.

TABLE 2

SARA Analysis of Extracted Bitumen Samples as a Function of Extraction Fluid

| | Oil Composition Normalized Weight Percent | | | |
|---|---|---|---|---|
| Extraction Fluid | Saturates | Aromatics | Resins | Asphaltenes |
| Ethyl Acetate | 21.30 | 53.72 | 22.92 | 2.05 |
| Pentane | 22.74 | 54.16 | 22.74 | 0.36 |
| Dichloromethane | 15.79 | 44.77 | 24.98 | 14.45 |
| Dimethyl Sulfide | 15.49 | 47.07 | 24.25 | 13.19 |
| Carbon Disulfide | 18.77 | 41.89 | 25.49 | 13.85 |
| o-Xylene | 17.37 | 46.39 | 22.28 | 13.96 |
| Tetrahydrofuran | 16.11 | 45.24 | 24.38 | 14.27 |
| Chloroform | 15.64 | 43.56 | 25.94 | 14.86 |

The SARA analysis showed that pentane and ethyl acetate were much less effective for extraction of asphaltenes from oil sands than are the known highly effective bitumen extraction fluids dichloromethane, carbon disulfide, o-xylene, tetrahydrofuran, and chloroform. The SARA analysis also showed that dimethyl sulfide has excellent miscibility properties for even the most difficult hydrocarbons—asphaltenes.

The data showed that dimethyl sulfide is generally as good as the recognized very good bitumen extraction fluids for recovery of bitumen from oil sands, and is highly compatible with saturates, aromatics, resins, and asphaltenes.

EXAMPLE 2

The quality of dimethyl sulfide as an oil recovery agent based on the crude oil viscosity lowering properties of dimethyl sulfide was evaluated. Three crude oils having widely disparate viscosity characteristics—an African Waxy crude, a Middle Eastern asphaltic crude, and a Canadian asphaltic crude—were blended with dimethyl sulfide. Some properties of the three crudes are provided in Table 3.

TABLE 3

Crude Oil Properties

| | African Waxy crude | Middle Eastern Asphaltic crude | Canadian Asphaltic Crude |
|---|---|---|---|
| Hydrogen (wt. %) | 13.21 | 11.62 | 10.1 |
| Carbon (wt. %) | 86.46 | 86.55 | 82 |
| Oxygen (wt. %) | na | na | 0.62 |
| Nitrogen (wt. %) | 0.166 | 0.184 | 0.37 |
| Sulfur (wt. %) | 0.124 | 1.61 | 6.69 |
| Nickel (ppm wt.) | 32 | 14.2 | 70 |
| Vanadium (ppm wt.) | 1 | 11.2 | 205 |
| microcarbon residue (wt. %) | na | 8.50 | 12.5 |
| $C_5$ Asphaltenes (wt. %) | <0.1 | na | 16.2 |
| $C_7$ Asphaltenes (wt. %) | <0.1 | na | 10.9 |
| Density (g/ml) (15.6° C.) | 0.88 | 0.9509 | 1.01 |
| API Gravity (15.6° C.) | 28.1 | 17.3 | 8.5 |
| Water (Karl Fisher Titration) (wt. %) | 1.65 | <0.1 | <0.1 |
| TAN-E (ASTM D664) (mg KOH/g) | 1.34 | 4.5 | 3.91 |
| Volatiles Removed by Topping, wt % | 21.6 | 0 | 0 |
| Saturates in Topped Fluid, wt. % | 60.4 | 41.7 | 12.7 |
| Aromatics in Topped Fluid, wt. % | 31.0 | 40.5 | 57.1 |
| Resin in Topped Fluid, wt. % | 8.5 | 14.5 | 17.1 |
| Asphaltenes in Topped Fluid, wt. % | 0.1 | 3.4 | 13.1 |
| Boiling Range Distribution | | | |
| Initial Boiling Point-204° C. (wt. %) | 8.5 | 3.0 | 0 |
| 204° C. (400° F.)-260° C. (wt. %) | 9.5 | 5.8 | 1.0 |
| 260° C. (500° F.)-343° C. (wt. %) | 16.0 | 14.0 | 14.0 |
| 343° C. (650° F.)-538° C. (wt. %) | 39.5 | 42.9 | 38.0 |
| >538° C. (wt. %) | 26.5 | 34.3 | 47.0 |

A control sample of each crude was prepared containing no dimethyl sulfide, and samples of each crude were prepared and blended with dimethyl sulfide to prepare crude samples containing increasing concentrations of dimethyl sulfide. The samples were heated to 60° C. to dissolve any waxes therein and to permit weighing of a homogeneous liquid. The samples were weighed, allowed to cool overnight, then blended with a selected quantity of dimethyl sulfide. The samples of the crude/dimethyl sulfide blend were then heated to 60° C. and mixed to ensure homogeneous blending of the dimethyl sulfide in the samples. Absolute (dynamic) viscosity measurements of each of the samples were taken using a closed cup rheometer using a PZ39 rotor sensor assembly in the rheometer. Viscosity measurements of each of the samples of the West African waxy crude and the Middle Eastern asphaltic crude were taken at 20° C., 40° C., 60° C., 80° C., and then again at 20° C. after cooling from 80° C., where the second measurement at 20° C. is taken to measure the viscosity without the presence of waxes since wax formation occurs slowly enough to permit viscosity measurement at 20° C. without the presence of wax. Viscosity measurements of each of the samples of the Canadian asphaltic crude were taken at 5° C., 10° C., 20° C., 40° C., 60° C., 80° C., The measured viscosities for each of the crudes are shown in Tables 4, 5, and 6 below.

TABLE 4

Viscosity (mPa s) of West African Waxy Crude vs. Temperature at Various levels of Dimethyl Sulfide Diluent

| DMS, wt. % | 20° C. | 40° C. | 60° C. | 80° C. | 20° C. |
|---|---|---|---|---|---|
| 0.00 | 128.8 | 34.94 | 15.84 | 9.59 | 114.4 |
| 1.21 | 125.8 | 30.94 | 14.66 | 8.92 | 100.1 |
| 2.48 | 122.3 | 30.53 | 13.66 | 8.44 | 89.23 |
| 5.03 | 78.37 | 20.24 | 10.45 | 6.55 | 55.21 |
| 7.60 | 60.92 | 17.08 | 9.29 | 6.09 | 40.89 |
| 9.95 | 44.70 | 13.03 | 7.58 | 5.04 | 30.61 |
| 15.13 | 23.96 | 8.32 | 4.97 | 3.38 | 17.64 |
| 19.30 | 15.26 | 6.25 | 4.05 | 2.92 | 12.06 |

TABLE 5

Viscosity (mPa s) of Middle Eastern Asphaltic Crude vs. Temperature at Various levels of Dimethyl Sulfide Diluent

| DMS, wt. % | 20° C. | 40° C. | 60° C. | 80° C. | 20° C. |
|---|---|---|---|---|---|
| 0.00 | 2936.3 | 502.6 | 143.6 | 56.6 | 2922.7 |
| 1.3 | 1733.8 | 334.5 | 106.7 | 44.6 | 1624.8 |
| 2.6 | 1026.6 | 219.9 | 76.5 | 34.3 | 881.1 |
| 5.3 | 496.5 | 134.2 | 52.2 | 25.5 | 503.5 |
| 7.6 | 288.0 | 89.4 | 37.4 | 19.3 | 290.0 |
| 10.1 | 150.0 | 52.4 | 24.5 | 13.5 | 150.5 |
| 15.2 | 59.4 | 25.2 | 13.6 | 8.2 | 60.7 |
| 20.1 | 29.9 | 14.8 | 8.7 | 5.7 | 31.0 |

TABLE 6

Viscosity (mPa s) of Topped Canadian Asphaltic Crude vs. Temperature at Various levels of Dimethyl Sulfide Diluent

| DMS, wt. % | 5° C. | 10° C. | 20° C. | 40° C. | 60° C. | 80° C. |
|---|---|---|---|---|---|---|
| 0.00 | | | 579804 | 28340 | 3403 | 732 |
| 1.43 | | | 212525 | 14721 | 2209 | 538 |
| 2.07 | | | 134880 | 10523 | 1747 | 427 |
| 4.87 | | | 28720 | 3235 | 985 | 328 |
| 8.01 | | | 5799 | 982 | 275 | 106 |
| 9.80 | | | 2760 | 571 | 173 | 73 |
| 14.81 | 1794 | 1155 | 548 | 159 | 64 | 32 |
| 19.78 | | | 188 | 69 | 33 | 19 |
| 29.88 | 113 | 81 | 51 | 22 | 13 | 8 |
| 39.61 | 23 | 20 | 14 | 8 | 6 | 4 |

Figure 9:
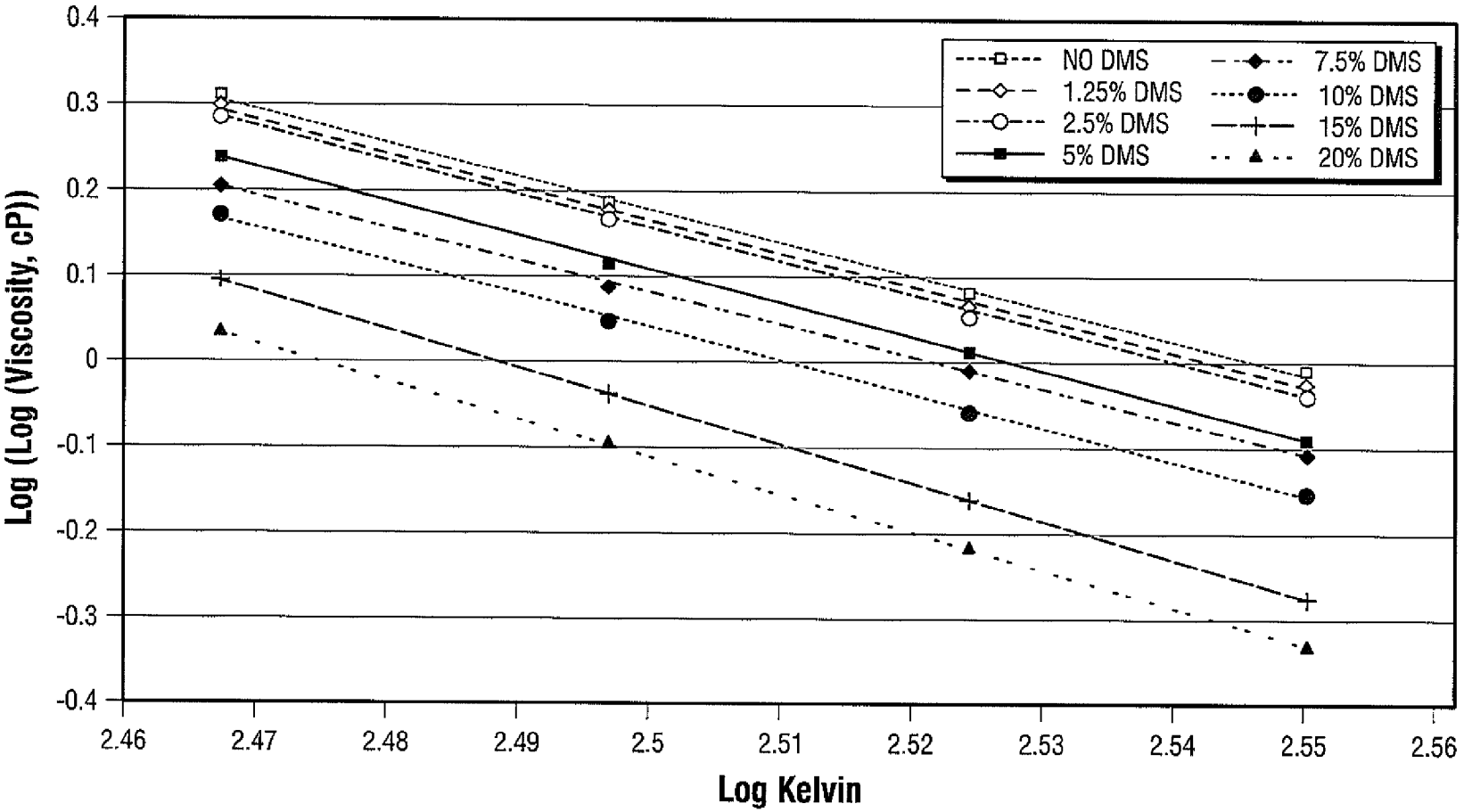
FIG. 9 is a graph showing the viscosity reducing effect of increasing concentrations of dimethyl sulfide on a West African Waxy crude oil.
Figure 10:
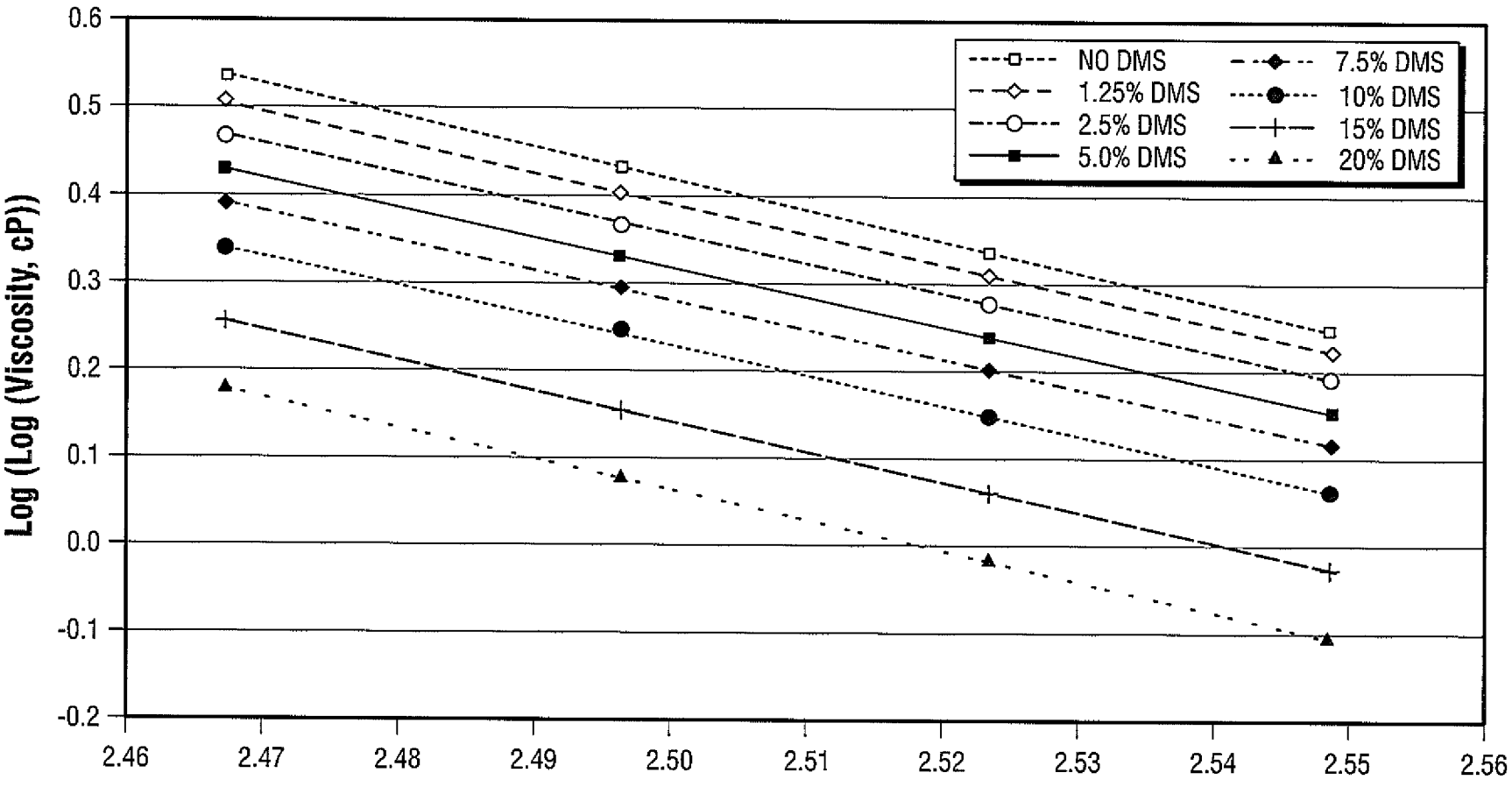
FIG. 10 is a graph showing the viscosity reducing effect of increasing concentrations of dimethyl sulfide on a Middle Eastern Asphaltic crude oil.
Figure 11:
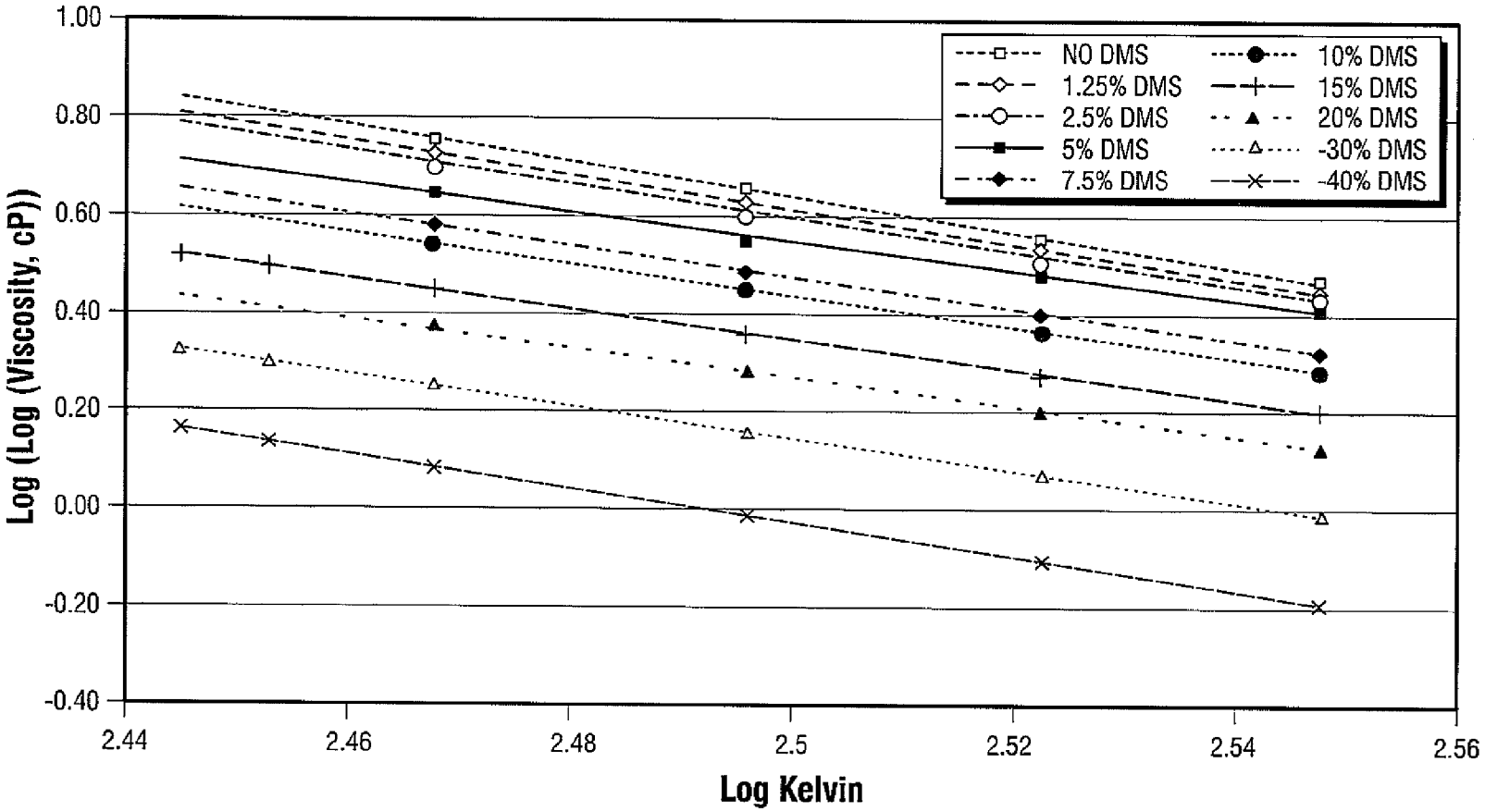
FIG. 11 is a graph showing the viscosity reducing effect of increasing concentrations of dimethyl sulfide on a Canadian Asaphaltic crude oil.

FIGS. 9, 10, and 11 show plots of Log[Log(Viscosity)] v. Log[Temperature ° K] derived from the measured viscosities in Tables 3, 4, and 5, respectively, illustrating the effect of increasing concentrations of dimethyl sulfide in lowering the viscosity of the crude samples.

The measured viscosities and the plots show that dimethyl sulfide is effective for significantly lowering the viscosity of a crude oil—particularly high asphaltene content, high viscosity, Canadian asphaltenic crude oil—over a wide range of initial crude oil viscosities.

EXAMPLE 3

Incremental recovery of oil from a formation core using an oil recovery formulation consisting of dimethyl sulfide following oil recovery from the core by water-flooding was measured to evaluate the effectiveness of DMS as a tertiary oil recovery agent.

Two 5.02 cm long Berea sandstone cores with a core diameter of 3.78 cm and a permeability between 925 and 1325 mD were saturated with a brine having a composition as set forth in Table 7.

TABLE 7

Brine Composition

| | Chemical component | | | | | |
|---|---|---|---|---|---|---|
| | $CaCl_2$ | $MgCl_2$ | KCl | NaCl | $Na_2SO_4$ | $NaHCO_3$ |
| Concentration (kppm) | 0.386 | 0.523 | 1.478 | 28.311 | 0.072 | 0.181 |

After saturation of the cores with brine, the brine was displaced by a Middle Eastern Asphaltic crude oil having the characteristics as set forth above in Table 3 to saturate the cores with oil.

Oil was recovered from each oil saturated core by the addition of brine to the core under pressure and by subsequent addition of DMS to the core under pressure. Each core was treated as follows to determine the amount of oil recovered from the core by addition of brine followed by addition of DMS. Oil was initially displaced from the core by addition of brine to the core under pressure. A confining pressure of 1 MPa was applied to the core during addition of the brine, and the flow rate of brine to the core was set at 0.05 ml/min. The core was maintained at a temperature of 50° C. during displacement of oil from the core with brine. Oil was produced and collected from the core during the displacement of oil from the core with brine until no further oil production was observed (24 hours). After no further oil was displaced from the core by the brine, oil was displaced from the core by addition of DMS to the core under pressure. DMS was added to the core at a flow rate of 0.05 ml/min for a period of 32 hours for the first core and for a period of 15 hours for the second core. Oil displaced from the core during the addition of DMS to the core was collected separately from the oil displaced by the addition of brine to the core.

The oil samples collected from each core by brine displacement and by DMS displacement were isolated from water by extraction with dichloromethane, and the separated organic layer was dried over sodium sulfate. After evaporation of volatiles from the separated, dried organic layer of each oil sample, the amount of oil displaced by brine addition to a core and the amount of oil displaced by DMS addition to the core were weighed. Volatiles were also evaporated from a sample of the Middle Eastern asphaltic oil to be able to correct for loss of light-end compounds during evaporation. Table 8 shows the amount of oil produced from each core by brine displacement followed by DMS displacement.

TABLE 8

| | Oil produced Brine displacement (ml) | Oil produced Brine displacement (of % oil initially in core) | Oil produced DMS displacement (ml) | Oil produced DMS displacement (of % oil initially in core) |
|---|---|---|---|---|
| Core 1 | 4.9 | 45 | 3.5 | 32 |
| Core 2 | 5.0 | 45 | 3.3 | 30 |

As shown in Table 8, DMS is quite effective for recovering an incremental quantity of oil from a formation core after recovery of oil from the core by waterflooding with a brine solution—recovering approximately 60% of the oil remaining in the core after the waterflood.

The present invention is well adapted to attain the ends and advantages mentioned as well as those that are inherent therein. The particular embodiments disclosed above are illustrative only, as the present invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered, combined, or modified and all such variations are considered within the scope of the present invention. The invention illustratively disclosed herein suitably may be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the element that it introduces. If there is any conflict in the usages of a word or term in this specification and one or more patent or other documents that may be incorporated herein by reference, the definitions that are consistent with this specification should be adopted.

What is claimed is:

1. A method for recovering petroleum comprising:

providing an oil recovery formulation that comprises at least 15 mol % dimethyl sulfide, wherein the oil recovery formulation is first contact miscible with liquid phase petroleum;

providing steam or hot water having a temperature of at least 85° C.;

introducing the steam or hot water and the oil recovery formulation together into a subterranean oil-bearing formation comprising crude oil having a dynamic viscosity of at least 1000 mPa s (1000 cP) at 25° C. and an API gravity at 15.5° C. (60° F.) of at most 20°, wherein the oil recovery formulation comprises at least 15 wt. % of the combined steam or hot water and oil recovery formulation introduced together into the formation;

contacting the steam or hot water and the oil recovery formulation with the oil in the formation; and producing oil from the formation after introducing the steam or hot water and the oil recovery formulation into the formation.

2. The method of claim 1 wherein the steam or hot water and the oil recovery formulation are introduced into the formation by injection via a first well extending into the formation.

3. The method of claim 1 wherein the oil is produced from the formation via the first well.

4. The method of claim 1 wherein the oil is produced from the formation via a second well extending into the formation.

5. The method of claim 4 wherein the second well is located below the first well in the formation.

6. The method of claim 1 wherein the oil recovery formulation is first contact miscible with petroleum that comprises at least 25 wt. % hydrocarbons having a boiling point of at least 538° C.

7. The method of claim 1 wherein the oil recovery formulation is comprised of at least 75 mol % dimethyl sulfide.

8. The method of claim 1 wherein the oil recovery formulation further comprises one or more compounds selected from the group consisting of pentane, isopentane, 2-methyl-2-butene, and isoprene.

9. The method of claim 1 further comprising producing the oil recovery formulation from the formation along with the oil.

10. The method of claim 9 further comprising separating the produced oil recovery formulation from at least a portion of the produced oil and introducing the separated produced oil recovery formulation into the formation together with steam or hot water having a temperature of at least 85° C.

11. The method of claim 1 further comprising producing water from the formation along with the oil.

12. The method of claim 11 further comprising separating the produced water from the produced oil, heating the separated produced water to form steam or hot water having a temperature of at least 85° C., and introducing the separated heated produced water into the formation as steam or hot water together with the oil recovery formulation.

13. The method of claim 1 wherein the steam provided has a vapor quality of from 0.7 to 1.0.

14. The method of claim 1 wherein the steam provided has a vapor quality of from 0.3 to less than 0.7.

15. The method of claim 1 wherein the steam is provided for at least a first period of time and for a second period of time, where the second period of time is after the first period of time, wherein the steam provided for the first period of time has a vapor quality of from 0.7 to 1.0, and wherein the steam provided for a second period of time has a vapor quality of from 0.3 to less than 0.7, where the steam provided for the first period of time is introduced into the formation together with the oil recovery formulation during the first period of time and the steam provided for the second period of time is introduced into the formation together with the oil recovery formulation for the second period of time.

16. The method of claim 1 wherein the oil recovery formulation has a dynamic viscosity of at most 0.35mPa s (0.35 cP) at 25° C.

17. The method of claim 1 wherein, prior to introducing the oil recovery formulation into the formation, a fluid flow path is established in the formation by injecting steam into the formation or by hydraulically fracturing the formation, and wherein the oil recovery formulation is introduced into the formation in the fluid flow path.

18. The method of claim 1 further comprising the step of introducing an oil immiscible formulation into the oil-bearing formation subsequent to the introduction of the oil recovery formulation and steam into the formation.

19. A system, comprising:

an oil recovery formulation comprised of at least 15 mol % dimethyl sulfide (DMS), wherein the oil recovery formulation is first contact miscible with liquid phase petroleum;

steam or hot water having a temperature of at least 85° C.;

a subterranean oil-bearing formation comprising crude oil having a viscosity of at least 1000 mPa s (1000 cP) at 25° C. and an API gravity at 15.5° C. (60° F.) of at most 20°;

a mechanism for introducing the oil recovery formulation and the steam or hot water together into the formation; and a mechanism for producing oil from the formation subsequent to the introduction of the oil recovery formulation and the steam or hot water into the formation.

20. The system of claim 19 wherein the subterranean oil-bearing formation is at a depth of at least 75 meters below the surface of the earth.

21. The system of claim 19 wherein the oil recovery formulation is further comprised of one or more compounds selected from the group consisting of pentane, isopentane, 2-methyl-2-butene, and isoprene.

22. The system of claim 19 wherein the oil recovery formulation is comprised of at least 75 mol % DMS.

23. The system of claim 19, wherein the mechanism for introducing the oil recovery formulation into the formation is located at a first well extending into the formation.

24. The system of claim 23 wherein the mechanism for producing oil from the formation is located at the first well extending into the formation.

25. The system of claim 23 wherein the mechanism for producing oil from the formation is located at a second well extending into the formation.

26. The system of claim 25 wherein the second well is located beneath the first well in the formation.

27. The system of claim 19 further comprising a boiler for producing steam wherein the boiler is operatively fluidly coupled to the mechanism for introducing the oil recovery formulation and the steam together into the formation.

28. The system of claim 19 further comprising:

an oil immiscible formulation; and a mechanism for introducing the oil immiscible formulation into the formation.

29. The system of claim 19 further comprising:

a mechanism for producing the oil recovery formulation from the formation;

a mechanism for separating the produced oil recovery formulation from oil and water produced from the formation; and a mechanism for introducing the produced separated oil recovery formulation into the formation.

* * * * *